US008707467B2

(12) United States Patent
Sohn

(10) Patent No.: US 8,707,467 B2
(45) Date of Patent: Apr. 29, 2014

(54) CAREGIVER COVER

(76) Inventor: Schalyn N. Sohn, Chantilly, VA (US)

( * ) Notice: Subject to any disclaimer, the term of this patent is extended or adjusted under 35 U.S.C. 154(b) by 158 days.

(21) Appl. No.: 13/104,976

(22) Filed: May 11, 2011

(65) Prior Publication Data

US 2012/0284893 A1 Nov. 15, 2012

(51) Int. Cl.
*A41D 1/20* (2006.01)

(52) U.S. Cl.
CPC ..... *A41D 1/205* (2013.01)
USPC ..... 2/104; 2/48; 2/49.1; 2/88

(58) Field of Classification Search
CPC ..... A41D 1/205; A41D 3/08; A41D 13/04; A41D 1/22; A41D 15/002; A41D 23/00; A41D 1/20; A41B 13/103; A41B 13/106; A41B 13/10
USPC ..... 2/104, 88, 48, 50, 49.4, 51, 49.1–49.5, 2/46, 111, 69.5, 207, 70, 52, 174
See application file for complete search history.

(56) References Cited

U.S. PATENT DOCUMENTS

| | | | | |
|---|---|---|---|---|
| 2,258,946 | A | 10/1941 | Chadwick | |
| 2,417,888 | A | 3/1947 | Schuster | |
| 2,482,182 | A | 9/1949 | Henninger | |
| 2,648,845 | A * | 8/1953 | Berman | 2/48 |
| 2,675,552 | A * | 4/1954 | Jackson | 2/69.5 |
| 2,831,193 | A | 4/1958 | Terry | |
| 2,857,599 | A | 10/1958 | Wallace | |
| 3,024,466 | A * | 3/1962 | Agostini | 2/48 |
| 3,871,027 | A | 3/1975 | Orr | |
| 4,528,699 | A * | 7/1985 | Hughes | 2/104 |
| 4,569,086 | A * | 2/1986 | Takefman | 2/49.2 |
| 4,651,349 | A | 3/1987 | Heiler | |
| 4,660,225 | A | 4/1987 | Kahn | |
| 4,697,287 | A | 10/1987 | Rose | |
| 4,712,251 | A | 12/1987 | Cobble | |
| 4,780,911 | A | 11/1988 | Mack | |
| 4,797,953 | A | 1/1989 | Dameron | |
| 4,924,528 | A * | 5/1990 | Trombetti-Dickens | 2/104 |
| 4,964,172 | A | 10/1990 | Bollard | |
| 4,987,612 | A | 1/1991 | Middleton | |
| 4,995,116 | A * | 2/1991 | Beauchamp et al. | 2/104 |
| 5,008,960 | A | 4/1991 | Hemming | |
| 5,034,999 | A * | 7/1991 | Lubbers | 2/104 |
| 5,038,411 | A | 8/1991 | St. Armand | |
| 5,042,090 | A | 8/1991 | Cook | |
| 5,090,059 | A | 2/1992 | Kahl | |

(Continued)

FOREIGN PATENT DOCUMENTS

GB 2443601 A * 5/2008

*Primary Examiner* — Amy Vanatta

(57) ABSTRACT

A caregiver cover with a stretched torus or other like shaped body and an elongated open or closed shaped neck opening. The caregiver cover provides adequate coverage of chest, shoulders, upper arms, and upper back of a caregiver to protect the caregiver's clothes from becoming soiled when burping, holding, bathing, or otherwise performing activities common to caring for a baby; and/or to provide adequate coverage for a nursing mother to maintain privacy while nursing without fully covering the baby; and/or to provide a comfortable surface for the baby. The body may be a soft, comfortable, absorbent fabric such as terry cloth, flannel, knit or the like and/or reversible. A neck fastener and/or a collar may be joined to the body. The body may be a single layer, a double layer, a triple layer, or multiple layers with a top panel, a middle panel, a bottom panel and/or multiple panels.

24 Claims, 13 Drawing Sheets

(56) References Cited

U.S. PATENT DOCUMENTS

| | | | | | |
|---|---|---|---|---|---|
| 5,107,545 | A | * | 4/1992 | Potter | 2/46 |
| 5,259,068 | A | * | 11/1993 | Carroll | 2/104 |
| 5,459,877 | A | | 10/1995 | Roberti | |
| 5,544,364 | A | * | 8/1996 | Weber | 2/104 |
| 5,570,474 | A | | 11/1996 | Berry et al. | |
| 5,573,153 | A | | 11/1996 | Stillman | |
| 5,625,897 | A | * | 5/1997 | Park | 2/69 |
| 5,709,000 | A | | 1/1998 | Hansen | |
| 5,848,439 | A | | 12/1998 | Huseth | |
| 5,950,235 | A | | 9/1999 | Tata | |
| 5,956,762 | A | | 9/1999 | Adams | |
| 5,960,471 | A | | 10/1999 | Burton | |
| D416,663 | S | * | 11/1999 | Thomas | D2/861 |
| 6,105,170 | A | | 8/2000 | Lisciandro | |
| 6,141,799 | A | | 11/2000 | Morris | |
| 6,182,290 | B1 | | 2/2001 | Morris | |
| 6,216,274 | B1 | * | 4/2001 | Harris | 2/104 |
| 6,327,712 | B1 | | 12/2001 | Armstrong | |
| 6,345,392 | B1 | | 2/2002 | Rios | |
| 6,532,596 | B1 | | 3/2003 | Fosmo | |
| 6,581,209 | B2 | | 6/2003 | Bramhan | |
| 6,990,686 | B2 | | 1/2006 | Palmer | |
| 7,082,617 | B1 | | 8/2006 | Poindexter | |
| 7,207,070 | B1 | | 4/2007 | Swarez-Ballesteros | |
| 7,316,035 | B2 | | 1/2008 | Archambault | |
| 7,469,424 | B2 | | 12/2008 | Good | |
| D585,631 | S | | 2/2009 | Barclay | |
| 7,555,790 | B2 | | 7/2009 | Ostrander | |
| 7,640,598 | B1 | | 1/2010 | Mallik | |
| 7,640,600 | B2 | | 1/2010 | Reder | |
| 7,765,609 | B2 | | 8/2010 | Chase | |
| 7,765,613 | B2 | | 8/2010 | Carr | |
| 7,784,108 | B2 | | 8/2010 | Ekelund et al. | |
| 7,805,770 | B2 | | 10/2010 | Ekelund et al. | |
| 7,805,771 | B2 | | 10/2010 | Ekelund et al. | |
| 7,810,171 | B2 | | 10/2010 | Moore | |
| 7,878,880 | B2 | | 2/2011 | Hendrickson | |
| 7,878,881 | B2 | | 2/2011 | Hendrickson | |
| 7,895,668 | B2 | | 3/2011 | Tinecheff | |
| 7,992,220 | B1 | | 8/2011 | McGoldrick | |
| D686,393 | S | * | 7/2013 | Sewall | D2/864 |
| 2003/0135909 | A1 | * | 7/2003 | LaTorre | 2/104 |
| 2004/0088773 | A1 | | 5/2004 | Andrews | |
| 2005/0066405 | A1 | | 3/2005 | Babiak | |
| 2008/0078027 | A1 | * | 4/2008 | Smith | 5/413 R |
| 2008/0263740 | A1 | | 10/2008 | Wright et al. | |
| 2010/0306896 | A1 | | 12/2010 | Schneider | |

* cited by examiner

CAREGIVER COVER

BACKGROUND

This application relates to a protective cover, also known as a nursing cover, garment protector, and/or a wear, primarily for an adult and, more particularly, to a protective cover for a caregiver of a baby for use when nursing, burping, holding, bathing, and other like uses when caring for a baby.

Feeding, burping, and holding a baby accounts for a significant amount of the time spent caring for a baby. The prior art lacks a versatile protective cover ("cover") that provides adequate coverage of chest, shoulders, upper arms, and upper back of a caregiver:

- to protect the caregiver's clothes from becoming soiled while caring for a baby when burping, holding, bathing, or otherwise performing activities common to caring for a baby; and/or
- to provide adequate coverage for a nursing mother to maintain privacy while nursing (breastfeeding) without fully covering baby; and/or
- to provide comfortable surface for baby while eating, burping, teething, being carried, or the like.

Babies are either nursed or given a bottle. When a mother nurses a baby she may expose a portion of her upper torso, which may make her uncomfortable if she is in a public area. Even if nursing from the top down, she may expose a portion of her breast or nipple area. Conventional solutions may be the use of a towel, blanket, or cloth, which is often bulky, uncomfortable, unsafe, and/or difficult to use. These types of materials when covering a baby may increase the body temperature of the mother and the baby, causing an uncomfortable and possibly unsafe breastfeeding experience. In addition, most conventional covers are difficult to use as they may fall off during use, thereby exposing the mother. A nursing mother needs to obtain adequate coverage via a protective cover she can wear while nursing her baby.

It is equally important for a caregiver to obtain adequate coverage to protect his clothes when burping a baby. Often a towel, blanket, or cloth is draped over the caregiver's shoulder to provide protection from regurgitation of fluids onto the caregiver's clothes. These materials are equally ineffective to use for protecting a caregiver's clothes when burping a baby as they are when nursing a baby due to being bulky, uncomfortable, and/or difficult to use. Because the items do not fasten around the caregiver's neck generally the towel, blanket, or cloth will fall off of the caregiver's shoulder while the caregiver is feeding the baby. Then, if the baby suddenly starts to gag or needs to burp, the caregiver must immediately put the baby on one of the caregiver's shoulders thereby exposing the caregiver's clothes to soiling because the caregiver did not have time to adequately place the towel, blanket, or cloth on his shoulder.

Even if the caregiver was able to place the towel, blanket, or cloth on his shoulder, frequently the item is not of sufficient size to provide adequate protection of the caregiver's chest, shoulders, upper arms, and upper back; or the item is too large and cumbersome to use. The caregiver also may want to alternate shoulders during the burping process and not constantly switch the towel or cloth to the other shoulder. Or the caregiver may want to allow the baby to rest in the chest area while burping. In any event the caregiver needs to obtain adequate coverage no matter where the baby is burped via the use of a protective cover the caregiver can wear.

All prior art designs have shortcomings in providing adequate coverage of chest, shoulders, upper arms, and upper back of a caregiver to protect the caregiver's clothes from becoming soiled during the care of the baby; and/or providing adequate coverage and privacy for a mother while nursing without fully covering the baby; and/or providing a comfortable surface for the baby while eating, burping, teething, being carried, or the like.

SUMMARY

The present invention is directed to a caregiver cover that obviates one or more of the problems related to the prior art. The caregiver cover provides adequate coverage when caring for a baby including a means for covering chest, shoulders, upper arms, and upper back of the caregiver. The caregiver cover may also have a means for providing various sized caregivers sufficient neck room while minimizing unprotected exposure. The caregiver cover may have a stretched torus, circle, flat ellipse, or other like shaped body and an open or closed shaped neck opening included within the body. In another aspect the caregiver cover body may be of fabric material and/or may be reversible. In another aspect the body may include a single layer, a double layer, a triple layer, or multiple layers with a top panel, a middle panel, a bottom panel, and/or multiple panels.

In another aspect the cover may have a neck fastener for holding cover around neck of various sized caregivers. In another aspect the caregiver cover may have a collar joined to the body allowing cover to be worn on various sized caregivers. In another aspect, a panel may be dissected into an upper panel and a lower panel. The upper panel and the lower panel may be removably fastened with a panel fastener. In another aspect, the double layer caregiver cover with the upper and the lower panels may have an internal pocket included within the body. In another aspect the caregiver cover may have a central fastener and/or a non-central fastener joined to the body. In another aspect a burp cloth may be removably joined to the body of the caregiver cover and/or a pocket may be on the body of the caregiver cover.

It is to be understood that both the foregoing general description and the following detailed description are exemplary and explanatory and are intended to provide further explanation of the invention as claimed.

BRIEF DESCRIPTION OF EMBODIMENTS

A complete understanding of the present invention may be obtained by reference to the accompanying drawings, when considered in conjunction with the subsequent, detailed description, in which.

REFERENCE NUMERALS

Figure 1A:
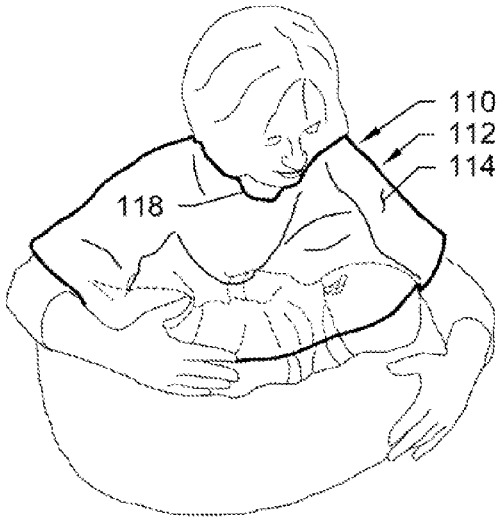
FIG. 1A is a front perspective view of a first embodiment of a caregiver cover while in use.

For purposes of clarity and brevity, like elements and components will bear the same designations and numbering throughout the Figures.

| | |
|---|---|
| 110 | body |
| 112 | double layer |
| 114 | top panel |
| 116 | bottom panel |
| 118 | neck opening |
| 120 | neck fastener |
| 120A | female neck fastener |
| 120B | male neck fastener |
| 210 | top upper panel |

-continued

| | |
|---|---|
| 212 | top lower panel |
| 214 | bottom upper panel |
| 216 | bottom lower panel |
| 218 | top panel fastener |
| 220 | bottom panel fastener |
| 222 | internal pocket |
| 224 | internal fastener |
| 310 | central fastener |
| 310A | upper fastener |
| 310B | lower fastener |
| 310C | lower interior fastener |
| 310D | lower exterior fastener |
| 410 | upper left fastener |
| 412 | lower left fastener |
| 414 | upper right fastener |
| 416 | lower right fastener |
| 510 | burp cloth |
| 510A | left burp cloth |
| 510B | right burp cloth |
| 512 | burp cloth fastener |
| 512A | burp cloth interior fastener |
| 512B | burp cloth exterior fastener |
| 610 | pocket |
| 610A | left pocket |
| 610B | right pocket |
| 710 | lower panel fastener |
| 810 | single layer |
| 910 | middle panel |
| 912 | triple layer |
| 1010 | collar |

DETAILED DESCRIPTION OF THE EMBODIMENTS

Reference will now be made in detail to embodiments of the present invention, examples of which are illustrated in the accompanying drawings. Embodiments, or examples of a caregiver cover may be implemented in numerous ways. A detailed description of one or more examples is provided below along with accompanying figures. The detailed description is provided in connection with such examples, but is not limited to any particular example. Details are set forth in the following description in order to provide a thorough understanding. These details are provided for the purpose of example and the descriptions provided may be used for implementation without some or all of these specific details. For the purpose of clarity, technical material that is known in the technical fields related to the examples has not been described in detail to avoid unnecessarily obscuring the description.

A caregiver cover ("cover") is described, including a protective cover, a nursing cover, a garment protector and/or a wear. The cover may include a body with a stretched torus, flat circle, ellipse, or other like shape. The caregiver cover may have an elongated open or closed shaped neck opening which may be circle, oval, crewneck, boat-neck, V-neck, or other like shape. An embodiment may have a neck fastener joined to body for holding the caregiver cover around a neck of various sized caregiver. An embodiment may have a flat, or other like type collar to allow caregiver to pull cover over his head rather than using the neck fastener. An embodiment may use both the neck fastener and/or a collar.

Although this embodiment is not limited to the type of material which may be used, in one aspect the body may be constructed from a soft, comfortable, absorbent fabric, such as terry cloth, flannel, knit, or other like material; and/or a water impervious material like nylon or other like material. A protective cover has the option to be reversible and either the top surface or bottom surface may be worn outwardly on the caregiver. Each of the reversible surfaces may be of the same material, or of different materials with the same or different properties.

A caregiver cover may include a single layer or multiple layers of material. If a caregiver cover includes a double layer of material, a cover may have a top panel and a bottom panel which may essentially be mirror images of each other. Although this embodiment is not limited to how the top panel and the bottom panel are joined together, the top panel and the bottom panel may be stitched or otherwise attached together. If a caregiver cover has a triple layer of fabric, a cover may have the middle panel sandwiched between the top panel and the bottom panel. The three layers may be stitched, attached, or otherwise joined together. A 'quilt' style stitching or other similar method may be used to prevent the middle panel(s) from shifting. A middle panel may include a filler like padding such as a soft batting; another layer of absorbent fabric such as terry cloth, flannel, knit, or other like fabric; and/or a water impervious material like nylon. A caregiver cover is not limited by a certain number of layers and/or the material(s) used.

When worn, a caregiver cover according to one aspect covers the chest, shoulders, upper arms, and upper back of a caregiver thereby providing adequate coverage when nursing, burping, holding, bathing, and other like uses when caring for a baby. For example, in one use, the caregiver cover allows a caregiver to burp a baby on either shoulder or chest area while preventing a caregiver's clothes from becoming soiled. The caregiver cover may allow a mother to partially cover a breastfeeding baby to protect mother's chest area from being exposed.

One embodiment of a caregiver cover allows a nursing mother to separate an upper panel from a lower panel thereby providing a window for the mother to observe and monitor a breastfeeding baby. An upper panel may be further separated from a lower panel allowing the breastfeeding baby to breastfeed on the outside of a cover while still providing coverage for a nursing mother's chest, and allowing a nursing mother to bond with her breastfeeding baby. One embodiment of a caregiver cover allows a nursing mother to use a central fastener and/or a non-central fastener to allow a nursing mother to observe, monitor, and bond with her breastfeeding baby. One embodiment may have the upper panel, the lower panel, and the central fastener.

One embodiment of a caregiver cover has burp cloths removably joined to the body providing a detachable layer of protection where the greatest likelihood of soiling may occur, thereby further protecting the caregiver's clothes and limiting the wash cycles required for the caregiver cover. One embodiment includes pocket(s) on body for storing small baby items such as extra burp cloths, baby wipes, baby pacifiers or other like items. For ease of transport, one embodiment allows a caregiver cover to be folded and fastened using a central fastener; and a different embodiment allows a caregiver cover to be folded into an internal pocket. Various alternative implementations and modifications to the examples provided may be used and are not limited to the descriptions, dimensions, and/or other details provided herein.

FIG. 1A is a front perspective view of a first embodiment of a caregiver cover while in use by a nursing mother with a breastfeeding baby. Body 110 with a stretched torus or other like shape covering chest, shoulders, upper arms, and upper back of a caregiver may include double layer 112, top panel 114 and bottom panel 116 (shown in FIG. 1H). Top panel 114 and bottom panel 116 may be mirror images of each other. Stretched torus or other like shaped body 110 may be extended to provide additional coverage of the upper torso and arms of a caregiver. Although this embodiment is not limited to the type of material which may be used, top panel 114 and bottom panel 116 may be constructed from a soft, comfortable, absorbent fabric such as terry cloth, flannel, knit, or other like material. Top panel 114 may be of a different material than bottom panel 116. For example, top panel 114 may be of a material like terry cloth or other like material and bottom panel 116 may be of a material like flannel or other like material.

Although this embodiment is not limited to how top panel 114 and bottom panel 116 contact each other; top panel 114 and bottom panel 116 may be stitched, attached, or otherwise joined together. The caregiver cover body 110 may be reversible such that either top panel 114 or bottom panel 116 of the cover may be worn outwardly on the caregiver. It is not required that the caregiver cover be reversible. If the reversible option is not necessary, then bottom panel 116 may be of a material such as a water impervious material like nylon.

Elongated open or closed shaped neck opening 118, included within body 110 may be circle, oval, crewneck, boat-neck, V-neck, or other like shape. Neck opening 118 may include neck fastener 120 (shown in FIG. 1E, FIG. 1G, and FIG. 1H) joined to body 110. Neck opening 118 is not limited to how the caregiver closes neck opening 118, although neck opening 118 may be fastened around the back of the caregiver's neck by neck fastener 120. Neck fastener 120 may be a hook and loop fastener, snap, button, cloth tie, magnet, zipper, or other like type. Although this embodiment is not limited to how neck fastener 120 is attached it may be stitched or otherwise joined onto body 110.

Figure 1B:
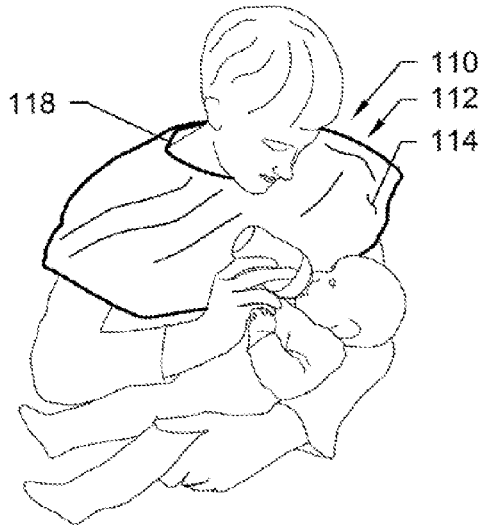
FIG. 1B is a front perspective view of the first embodiment of a caregiver cover while in use.

FIG. 1B is a front perspective view of the first embodiment of a caregiver cover while in use by a caregiver feeding a baby a bottle. This figure shows body 110 with double layer 112 having top panel 114 and bottom panel 116 (shown in FIG. 1H), neck opening 118, and neck fastener 120 (shown in FIG. 1E, FIG. 1G, and FIG. 1H), as described in FIG. 1A.

Figure 1C:
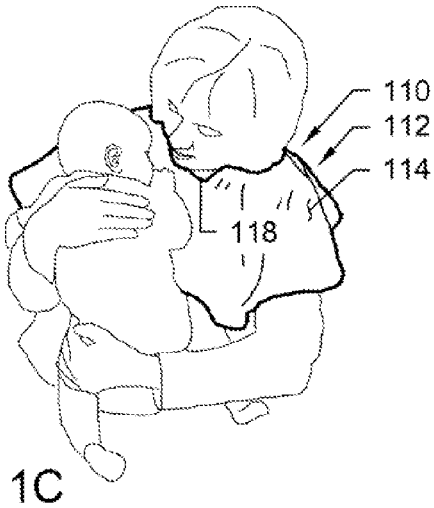
FIG. 1C is a front perspective view of the first embodiment of a caregiver cover while in use.

FIG. 1C is a front perspective view of the first embodiment of a caregiver cover while in use by a caregiver burping a baby. This figure shows body 110 with double layer 112 having top panel 114 and bottom panel 116 (shown in FIG. 1H), neck opening 118, and neck fastener 120 (shown in FIG. 1E, FIG. 1G, and FIG. 1H), as described in FIG. 1A.

Figure 1D:
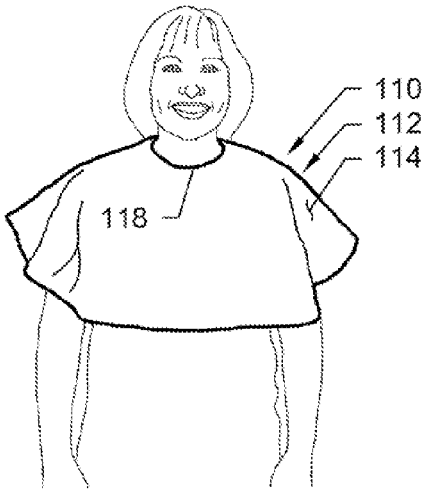
FIG. 1D is a front perspective view of the first embodiment of a caregiver cover.

FIG. 1D is a front perspective view of the first embodiment of a caregiver cover. This figure shows body 110 with double layer 112 having top panel 114 and bottom panel 116 (shown in FIG. 1H), neck opening 118, and neck fastener 120 (shown in FIG. 1E, FIG. 1G, and FIG. 1H), as described in FIG. 1A.

Figure 1E:
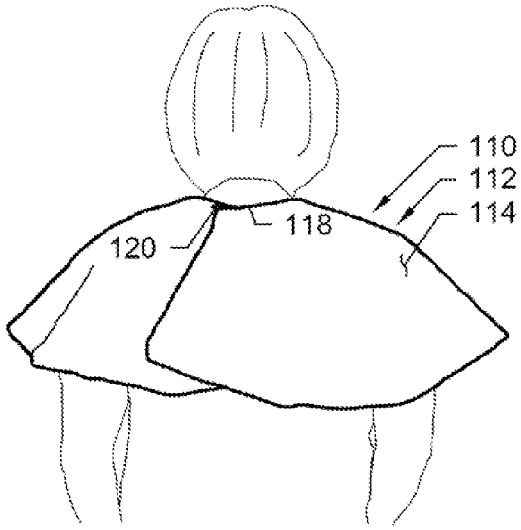
FIG. 1E is a rear perspective view of the first embodiment of a caregiver cover.

FIG. 1E is a rear perspective view of the first embodiment of a caregiver cover. This figure shows body 110 with double layer 112 having top panel 114 and bottom panel 116 (shown in FIG. 1H), neck opening 118, and neck fastener 120 as described in FIG. 1A.

Figure 1F:
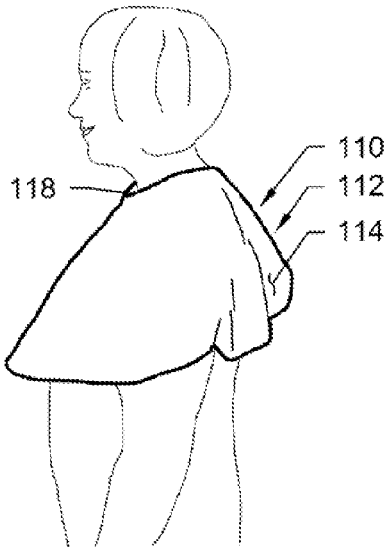
FIG. 1F is a left perspective view of the first embodiment of a caregiver cover.

FIG. 1F is a left perspective view of the first embodiment of a caregiver cover. This figure shows body 110 with double layer 112 with top panel 114 and bottom panel 116 (shown in FIG. 1H), neck opening 118, and neck fastener 120 (shown in FIG. 1E, FIG. 1G, and FIG. 1H), as described in FIG. 1A.

Figure 1G:
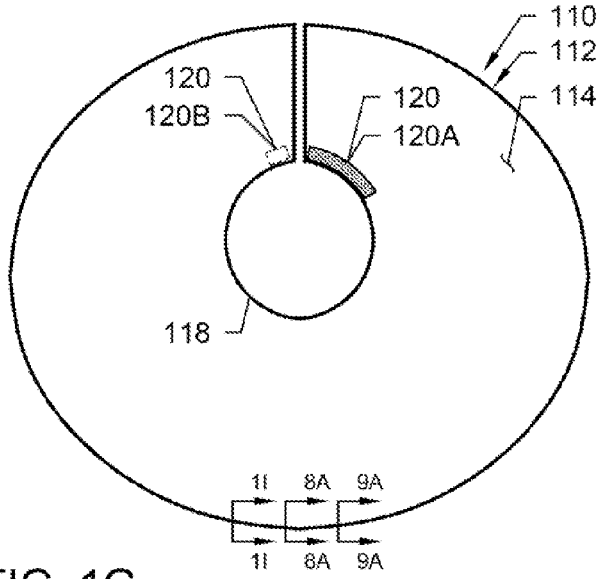
FIG. 1G is a top view of the first embodiment of a caregiver cover.

FIG. 1G is a top view of the first embodiment of a caregiver cover. This figure shows stretched torus body 110 with double layer 112 having top panel 114 and bottom panel 116 (shown in FIG. 1H). Elongated open or closed shaped neck opening 118 included within body 110 may be circle, oval, crewneck, boat-neck, V-neck, or other like shape. In one aspect, neck fastener 120 may include female neck fastener 120A component and male neck fastener 120B component joined to body 110. A fastener like OMNI-TAPE® brand fastener may be used where the hook and loop may be woven on the same surface and so technically the female component of the fastener may be essentially the same as the male component of the fastener. Although this embodiment is not limited to how neck fastener 120 is attached it may be stitched or otherwise joined onto body 110. The caregiver may fasten female neck fastener 120A component to male neck fastener 120B component to close the cover around his neck. All elements are described in FIG. 1A.

Figure 1H:
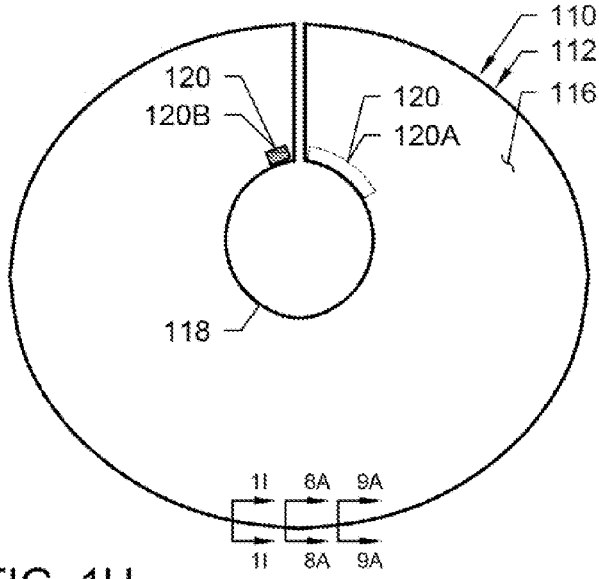
FIG. 1H is a bottom view of the first embodiment of a caregiver cover.

FIG. 1H is a bottom view of the first embodiment of a caregiver cover. This figure shows an essentially mirror image of the top view (shown in FIG. 1G) of body 110 with double layer 112 having top panel 114 (shown in FIG. 1G) and bottom panel 116, neck opening 118, and neck fastener 120. Neck fastener 120 may include female neck fastener 120A component and male neck fastener 120B component as described in FIG. 1G. All elements are described in FIG. 1A.

Figure 1I:
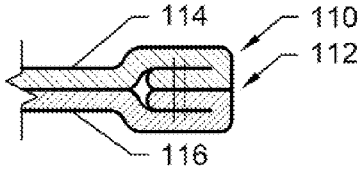
FIG. 1I is a section view of the first embodiment of a caregiver cover.

FIG. 1I is a section view taken from FIG. 1G and FIG. 1H of the first embodiment of a caregiver cover showing body 110 with top panel 114 and bottom panel 116 which may be connected, joined, and/or stitched together forming a double layer 112.

FIG. 1A through FIG. 1H illustrates a versatile caregiver cover's stretched torus or other like shaped body 110 which may adequately cover the chest, shoulders, upper arms, and upper back of a caregiver to protect the caregiver's clothes from becoming soiled during the care of a baby such as when burping, holding, bathing, and other like uses when caring for a baby; and/or to provide adequate coverage for a nursing mother so she can maintain privacy while nursing without fully covering her baby; and/or to provide a comfortable surface for the baby while eating, burping, teething, being carried, or the like.

The figures demonstrate elongated open or closed shaped neck opening 118 may be a circle, oval, crewneck, boat-neck, V-neck, or other like shape to provide various sized caregivers sufficient neck room while minimizing unprotected exposure. The figures also show neck fastener 120 joined to body 110 which may be made of a hook and loop fastener, snap, button, cloth tie, magnet, zipper, or other like type to accommodate various sized caregivers. Neck fastener 120 allows the caregiver cover to be held around a nursing mother's neck and/or a caregiver when burping holding, bathing, and other like uses when caring for a baby. Neck fastener 120 may be fastened in the back or front of a caregiver.

In one aspect, body 110 may be soft, comfortable, absorbent, fabric to create a versatile cover that may be used to provide privacy coverage for a nursing mother; and/or to provide coverage of a caregiver when burping, holding, bathing a baby, or the like; and/or to provide a comfortable surface for a baby while eating, burping, teething, being carried, or the like. The baby may be able to chew on the cover to provide relief from teething pain. The caregiver cover may provide some padding or additional comfort for baby. The cover may protect a caregiver's clothes when getting a wet baby out of the bathtub and then it may be used to wrap the baby to help dry the baby.

FIG. 1A specifically shows how stretched torus or other like shaped body 110 provides full privacy for a nursing mother while partially covering a breastfeeding baby. Partially covering the baby rather than fully covering the baby thereby prevents the baby from becoming overheated and/or irritated if the baby does not like to be fully covered when breastfeeding. FIG. 1B and FIG. 1C illustrates how stretched torus or like shaped body 110 is useful for a nursing and non-nursing caregiver as the shape does not give the caregiver the appearance of wearing a nursing cover. FIG. 1E demonstrates how a caregiver cover's stretched torus shape may overlap in the back such that the caregiver's clothes are not exposed. If the caregiver preferred, the caregiver cover may be fastened in the front because the caregiver cover may still provide adequate coverage of the chest, shoulders, upper arms, and upper back of a caregiver.

FIG. 1I illustrates how top panel 114 and bottom panel 116 which may be essentially mirror images of each other and may contact each other in a way to form body 110 including double layer 112 while still allowing the caregiver cover to be reversible. Double layer 112 provides additional protection for a caregiver's clothes. A reversible cover limits the number of times the cover needs to be washed. Top panel 114 and bottom panel 116 may be constructed from a soft, comfortable absorbent fabric such as terry cloth, flannel, knit, or other like material. Top panel 114 and bottom panel 116 may be stitched together or otherwise joined together to form body 110. Top panel 114 may be of a different material than bottom panel 116; for example, top panel 114 may be of a material like terry cloth or other like material and the bottom may be of a material like flannel or other like material. Thus, it may be possible to accommodate different preferences of the caregiver and/or the baby.

Figure 2A:
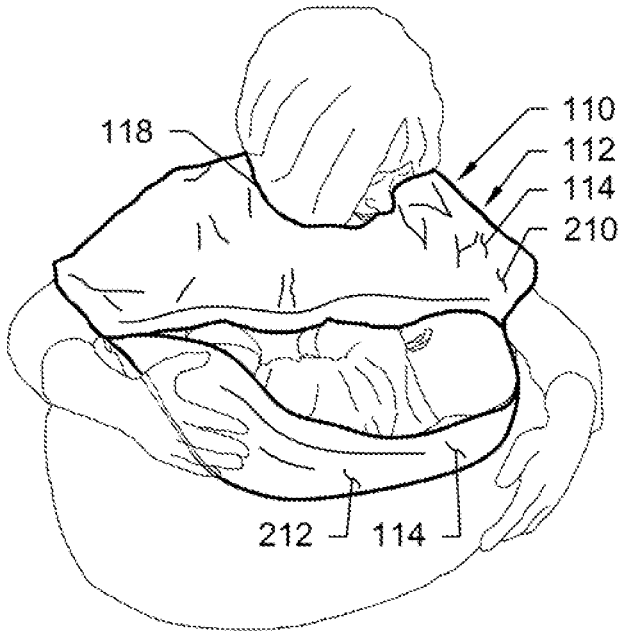
FIG. 2A is a front perspective view of a second embodiment of a caregiver cover while in use.
Figure 2B:
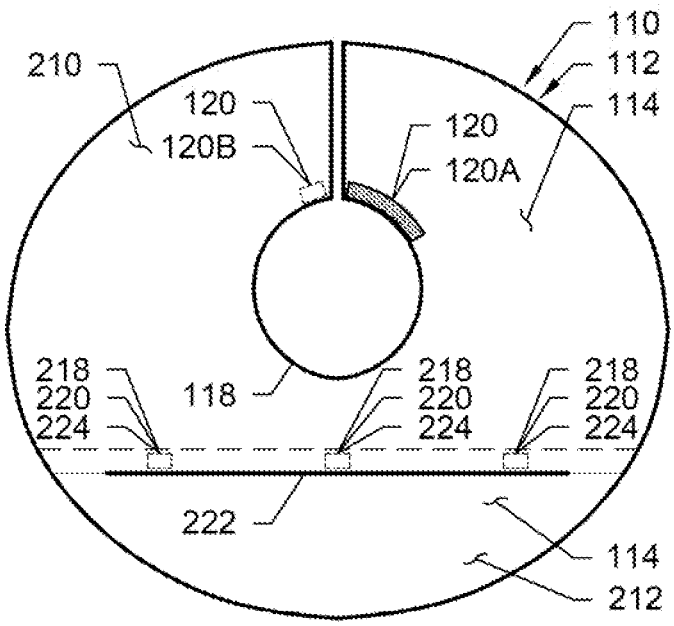
FIG. 2B is a top view of the second embodiment of a caregiver cover.
Figure 2C:
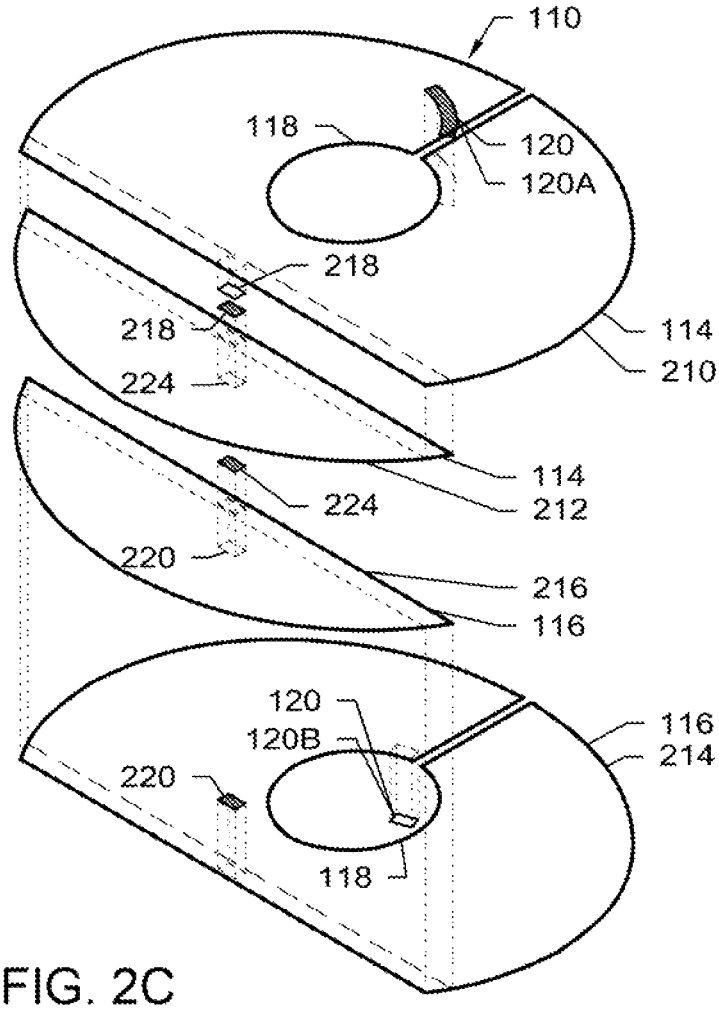
FIG. 2C is an exploded view of the second embodiment of a caregiver cover.

FIG. 2A is a front perspective view of a second embodiment of a caregiver cover while in use by a mother with a breastfeeding baby with top upper panel 210 and bottom upper panel 214 (shown in FIG. 2C) separated from top lower panel 212 and bottom lower panel 216 (shown in FIG. 2C). Similar to the first embodiment, the present embodiment includes body 110 with a stretched torus or other like shape covering chest, shoulders, upper arms, and upper back of a caregiver and may have a double layer 112 with top panel 114 and bottom panel 116 (shown in FIG. 2C); elongated open or closed shaped neck opening 118 included within body 110 which may be a circle, oval, crewneck, boat-neck, V-neck, or other like shape. A neck fastener 120 may be joined to body 110 for (shown in FIG. 2B and FIG. 2C) holding the cover around the caregiver. As discussed in FIG. 1A, stretched torus or other like shaped body 110 may be extended to provide additional coverage of the upper torso and arms of the caregiver. Please refer to FIG. 1A through FIG. 1F for views of how this embodiment may look when top upper panel 210 and bottom upper panel 214 are not separated from top lower panel 212 and bottom lower panel 216 as the views may be substantially similar.

As shown in FIG. 2A, the caregiver cover may have a panel dissected into an upper panel and a lower panel included within body 110. Top panel 114 may be dissected into top upper panel 210 and top lower panel 212 and bottom panel 116 may be dissected into bottom upper panel 214 and bottom lower panel 216. Bottom upper panel 214 may be essentially a mirror image of top upper panel 210 and bottom lower panel 216 may be essentially a mirror image of top lower panel 212 as shown in FIG. 2C.

FIG. 2B is a top view of the second embodiment of a caregiver cover. As discussed in FIG. 2A, this embodiment may have stretched torus or other like shaped body 110 with double layer 112 having top panel 114 and bottom panel 116 (shown in FIG. 2C). Elongated open or closed shaped neck opening 118 included within body 110 may be a circle, oval, crewneck, boat-neck, V-neck, or other like shape. Neck fastener 120, may have female neck fastener 120A component and male neck fastener 120B component joined to body 110.

Figure 7A:
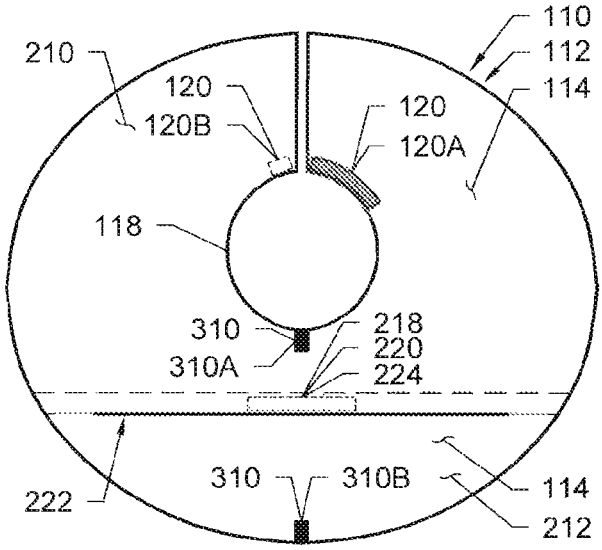
FIG. 7A is a top view of a seventh embodiment of a caregiver cover.

FIG. 2B shows how the top upper panel 210 which may have a stretched torus with a substantially straight lower edge may overlap the upper edge of top lower panel 212 which may have a substantially curved lower edge. Top upper panel 210 may be fastened to top lower panel 212 with top panel fastener 218. Underneath top upper panel 210 may be bottom upper panel 214 and underneath top lower panel 212 may be bottom lower panel 216. Bottom upper panel 214 may overlap bottom lower panel 216 as shown in FIG. 2C and bottom upper panel 214 may be fastened to bottom lower panel 216 with bottom panel fastener 220. Top lower panel 212 and bottom lower panel 216 may form internal pocket 222. Internal pocket 222 may be fastened with internal fastener 224. Top panel fastener 218, bottom panel fastener 220, and internal fastener 224 may be located in several locations as depicted on FIG. 2B and/or may be of sufficient length to be located in only one location (as shown in FIG. 7A).

FIG. 2C is an exploded view of the second embodiment of a caregiver cover. FIG. 2C is an example of the second embodiment of a caregiver cover which illustrates how a caregiver cover with body 110 may be double layer 112. Top panel 114 may be dissected into the top upper panel 210 which may have a stretched torus with a substantially straight lower edge and top lower panel 212 with a substantially curved lower edge. Bottom panel 116 may be dissected into bottom upper panel 214 which may have a stretched torus with a substantially straight lower edge and bottom lower panel 216 with a substantially curved lower edge. Body 110 may be joined together with top upper panel 210 which overlaps top lower panel 212; top lower panel 212 may be directly above bottom lower panel 216 with bottom upper panel 214 on the very bottom and all four panels joined and/or stitched together in that order.

Figure 2D:
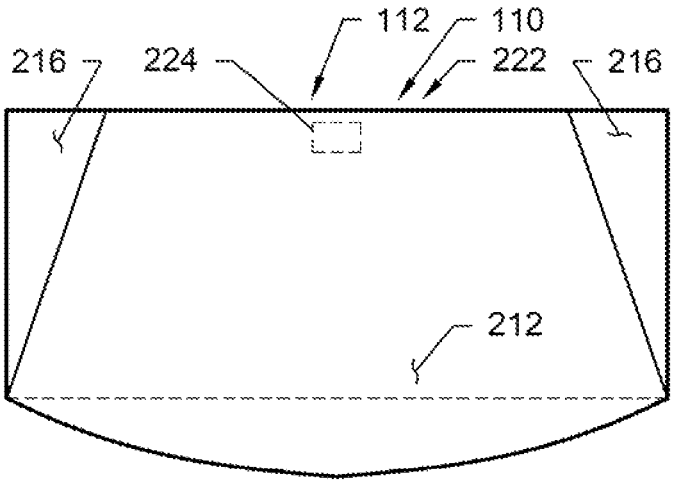
FIG. 2D is a top view of the second embodiment of a caregiver cover folded.

Top upper panel 210 may be fastened to top lower panel 212 with top panel fastener 218. Top panel fastener 218 may be stitched, attached, or otherwise joined to top upper panel 210 and top lower panel 212. Bottom upper panel 214 may be fastened to bottom lower panel 216 with bottom panel fastener 220. Bottom panel fastener 220 may be stitched, attached, or otherwise joined to bottom upper panel 214 and bottom lower panel 216. Top lower panel 212 and bottom lower panel 216 may form internal pocket 222 (as shown in FIG. 2D). Internal pocket 222 may be fastened with internal fastener 224.

Top panel fastener 218, bottom panel fastener 220, and internal fastener 224 may be a hook and loop fastener, snap, button, cloth tie, magnet, zipper, or other like type. Top panel fastener 218, bottom panel fastener 220, and/or internal fastener 224 may be located centrally and/or on the right side and/or on the left side as shown in FIG. 2B. There may be multiple top panel fasteners and/or bottom panel fasteners and/or internal fasteners and/or the fasteners may be of sufficient length to substantially fasten with just one top panel fastener 218, one bottom panel fastener 220, and one internal fastener 224 which may be centrally located as shown in FIG. 2C and FIG. 7A.

Top panel fastener 218 may include female top panel fastener 218 component on bottom surface of top upper panel 210 and male top panel fastener 218 component on top surface of top lower panel 212. Internal fastener 224 may be located directly below top panel fastener 218 and may include female internal fastener 224 component on bottom surface of top lower panel 212 and male internal fastener 224 component on top surface of bottom lower panel 216. Bottom panel fastener 220 may be located directly below internal fastener 224 and may include female bottom panel fastener 220 on the top surface of bottom upper panel 214 and male bottom panel fastener 220 component on the bottom surface of bottom lower panel 216. A fastener like OMNI-TAPE® brand fastener may be used where the hook and loop may be woven on the same surface and so technically the female component of the fastener may be substantially the same as the male component of the fastener. The fasteners and fastener components may be stitched or otherwise adhered or joined to their respective panels.

Another example of how the second embodiment may be connected together, not shown in FIG. 2C, may be top upper panel 210 may be directly on top of bottom upper panel 214 which may be on top of top lower panel 212 which may be on top of bottom lower panel 216 with the panels joined in that order. Either example may have the same outcome of both top upper panel 210 and bottom upper panel 214 overlapping top lower panel 212 and bottom lower panel 216 and top lower panel 212 and bottom lower panel 216 may still form internal pocket 222; the only difference may be the order in which the panels may be connected together. The panels may be removably fastened, stitched or otherwise adhered or joined to one another.

Top upper panel 210 may go on top of bottom upper panel 214 and those panels may be joined with a panel fastener or the panels may be stitched or otherwise joined together and then a panel fastener may be used to fasten top upper panel 210 and bottom upper panel 214 to top lower panel 212 and bottom lower panel 216. Bottom upper panel 214 may be excluded (FIG. 8A) and top upper panel 210 may be used with a top lower panel 212 and bottom lower panel 216. Top lower panel 212 and bottom lower panel 216 may still use internal fastener 224 to fasten top lower panel 212 and bottom lower panel 216. Top lower panel 212 and bottom lower panel 216 may be partially adhered, stitched or otherwise joined, thereby maintaining the internal pocket 222 or the bottom panels may be stitched, adhered or otherwise joined together thereby eliminating internal pocket 222 and/or internal fastener 224.

Another example of how the second embodiment may be produced, not shown, may be to adhere, stitch or join top panel 114 and bottom panel 116 and then dissect the panels by cutting a slit or other like method to create an opening in each panel thereby top panel 114 may have top upper panel 210 and top lower panel 212 and bottom panel 116 may have bottom upper panel 214 and bottom lower panel 216.

FIG. 2D is a top view of the second embodiment of a caregiver cover folded into internal pocket 222. This figure illustrates how body 110 including top panel 114 with top upper panel 210 and top lower panel 212; and bottom panel 116 with bottom upper panel 214 and bottom lower panel 216; form double layer 112 may be folded into internal pocket 222 and closed with internal fastener 224. Top panel fastener 218 may be located on top lower panel which may be directly above internal fastener 224, but has been removed from FIG. 2D for clarity.

Figure 3A:
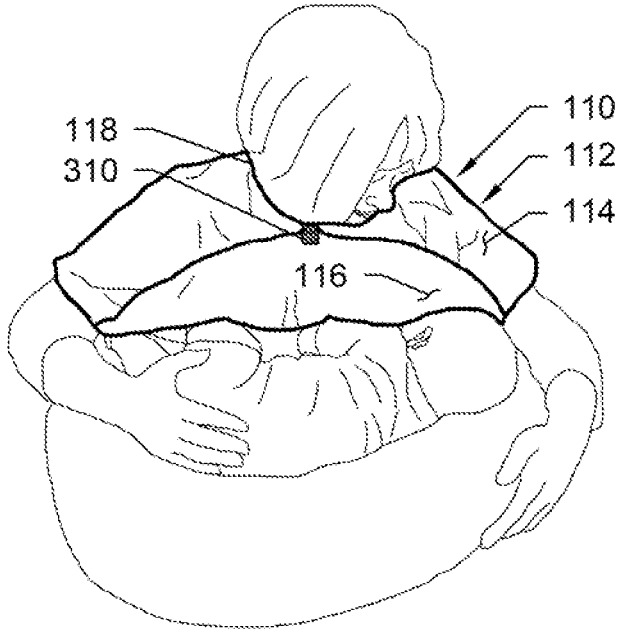
FIG. 3A is a front perspective view of a third embodiment of a caregiver cover while in use.

FIG. 3A is a front perspective view of a third embodiment of a caregiver cover while in use by a mother with a breast-feeding baby while central fastener 310 is engaged. As described in the first embodiment, FIG. 1A through FIG. 1I, the present embodiment may include body 110 with a stretched torus or other like shape covering chest, shoulders, upper arms, and upper back of a caregiver that includes double layer 112 with top panel 114 and bottom panel 116; elongated open or closed shaped neck opening 118 included within body 110 may be a circle, oval, crewneck, boat-neck, V-neck, or other like shape; and neck fastener 120 (shown in FIG. 3C) for holding the cover around a caregiver. As discussed in FIG. 1A, stretched torus or other like shaped body 110 may be extended to provide additional coverage of the upper torso and arms of a caregiver. Please refer to FIG. 1A through FIG. 1F for views of how this embodiment may look when central fastener 310 is not fastened as the views may be substantially similar.

Central fastener 310 may be a hook and loop, snap, button, cloth tie, magnet, or other like type attached or otherwise joined to body 110. Although this embodiment is not limited to how central fastener 310 is attached, it may be stitched or otherwise joined onto body 110.

Figure 3B:
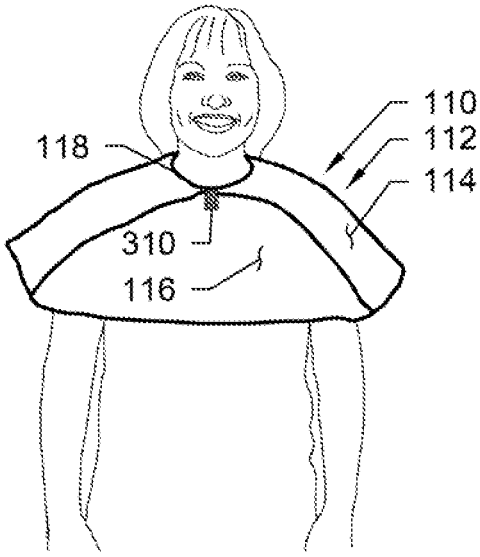
FIG. 3B is a front perspective view of the third embodiment of a caregiver cover.

FIG. 3B is a front perspective view of the third embodiment of a caregiver cover with central fastener 310 engaged. As discussed in FIG. 3A, this embodiment like the first embodiment may have stretched torus or other like shaped body 110 with double layer 112 having top panel 114 and bottom panel 116. Elongated open or closed shaped neck opening 118 included within body 110 may be a circle, oval, crewneck, boat-neck, V-neck, or other like shape. Neck fastener 120 may be joined to body 110.

Figure 3C:
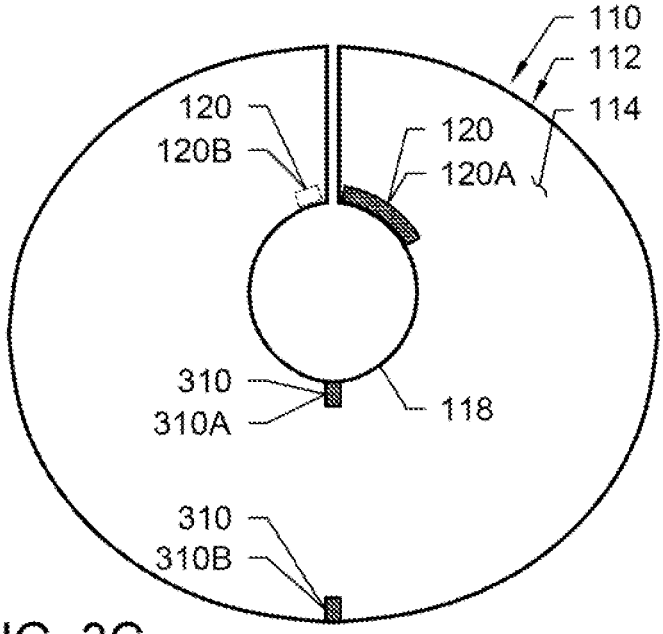
FIG. 3C is a top view of the third embodiment of a caregiver cover.

FIG. 3C is a top view of the third embodiment of a caregiver cover without central fastener 310 engaged. As discussed in FIG. 3A, this embodiment like the first embodiment may have stretched torus or other like shaped body 110 with double layer 112 having top panel 114 and bottom panel 116. Elongated open or closed shaped neck opening 118 included within body 110 may be a circle, oval, crewneck, boat-neck, V-neck, or other like shape. Neck fastener 120, having female neck fastener 120A component and male neck fastener 120B component may be joined to body 110. In this third embodiment central fastener 310 may be upper fastener 310A component and lower fastener 310B component made of a hook and loop, snap, button, cloth tie, magnet, or other like type and it may be directly attached to body 110 as described in FIG. 3A.

Figure 3D:
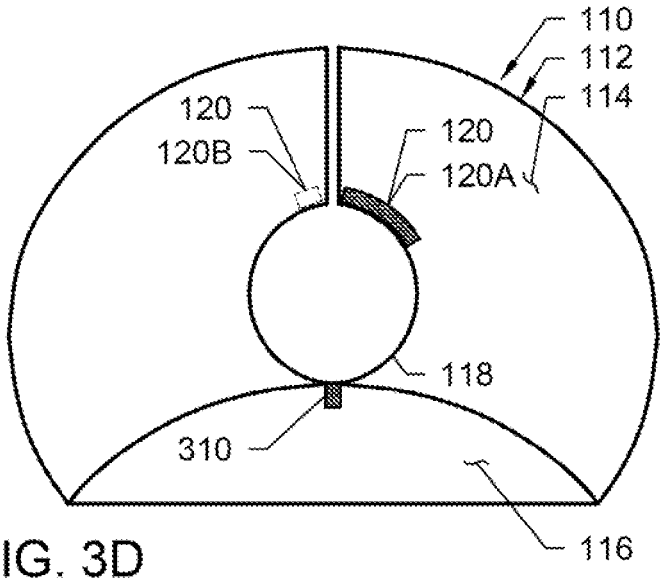
FIG. 3D is a top view of the third embodiment of a caregiver cover.

FIG. 3D is a top view of the third embodiment of a caregiver cover with central fastener 310 engaged. As discussed in FIG. 3A, this embodiment like the first embodiment may have stretched torus or other like shaped body 110 with double layer 112 having top panel 114 and bottom panel 116. Elongated open or closed shaped neck opening 118 included within body 110 may be a circle, oval, crewneck, boat-neck, V-neck, or other like shape. Neck fastener 120, having female neck fastener 120A component and male neck fastener 120B component may be joined to body 110. In this third embodiment central fastener 310 may be a hook and loop, snap, button, cloth tie, magnet, or other like type and it may be directly attached to body 110 as described in FIG. 3A.

Figure 3E:
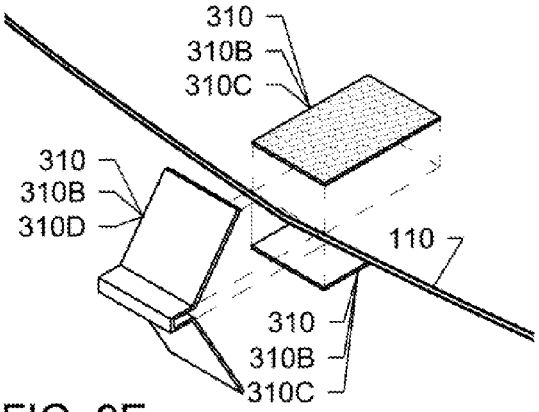
FIG. 3E is an exploded view of a lower interior fastener component and a lower exterior fastener component of a lower fastener of the third embodiment of a caregiver cover.

FIG. 3E is an exploded view of lower fastener 310B component of central fastener 310 with lower interior fastener 310C component and lower exterior fastener 310D component of the third embodiment of a caregiver cover. As discussed in FIG. 3A central fastener may be made of a hook and loop, snap, button, cloth tie, magnet, or other like type and may be attached to body 110. If a hook and loop or other like type fastener is used for central fastener 310 and it is desirable to have only the soft, loop side face up, lower fastener 310B component may have lower interior fastener 310C component and lower exterior fastener 310D component. Lower interior fastener 310C component may have the soft, loop portion face up and lower exterior fastener 310D component may have the hook portion face down. When the caregiver needs to engage central fastener 310, lower exterior fastener 310D component may be unconnected from lower interior fastener 310C component and may be fastened to upper fastener 310A component. If the hook portion is soft enough that it does not warrant the need to be covered, then lower fastener 310B component may simply include one hook fastener face up to fasten to the upper fastener when the caregiver needs to connect central fastener 310. A fastener like OMNI-TAPE brand fastener may be used where the hook and loop may be woven on the same surface and so upper fastener 310A component and lower fastener 310B component may be of the same material.

Figure 3F:
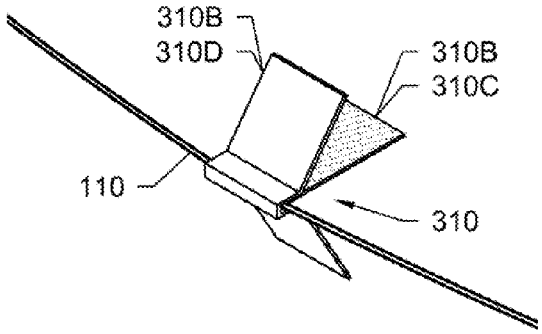
FIG. 3F is an assembled view of the lower interior fastener component and a lower exterior fastener component of a lower fastener of the third embodiment of a caregiver cover.

FIG. 3F is an assembled view of lower fastener 310B component of central fastener 310 with lower interior fastener 310C component and lower exterior fastener 310D component of the third embodiment of a caregiver cover. Central fastener 310 may be stitched or otherwise attached onto body 110.

Figure 3G:
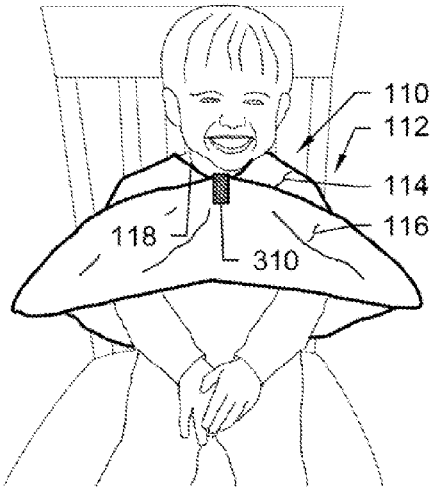
FIG. 3G is a front perspective view of the third embodiment of a caregiver cover while in use.

FIG. 3G is a front perspective view of the third embodiment of a caregiver cover while in use by a young child showing central fastener 310 with lower fastener 310B component engaged with upper fastener 310A component. As discussed in FIG. 3A, this embodiment like the first embodiment may have stretched torus or other like shaped body 110 with double layer 112 having top panel 114 and bottom panel 116. Elongated open or closed shaped neck opening 118 included within body 110 may be a circle, oval, crewneck, boat-neck, V-neck, or other like shape. Neck fastener 120 may be joined to body 110. In this third embodiment central fastener 310 may be a hook and loop, snap, button, cloth tie, magnet, or other like type and it may be directly attached to body 110 as described in FIG. 3A.

Figure 3H:
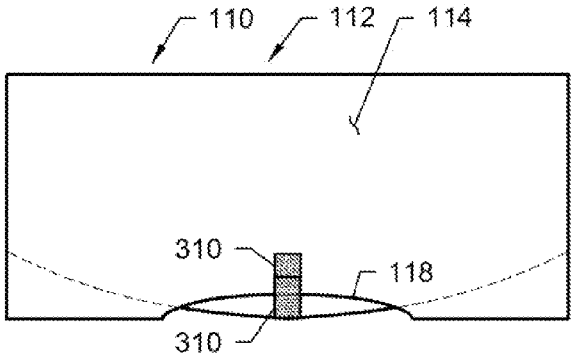
FIG. 3H is a top view of the third embodiment of the caregiver cover folded.

FIG. 3H is a top view of the third embodiment of a caregiver cover with body 110 with elongated open or closed shaped neck opening 118 having of double layer 112 with top panel 114 and bottom panel 116 folded and fastened to central fastener 310 for ease of transport.

Figure 4A:
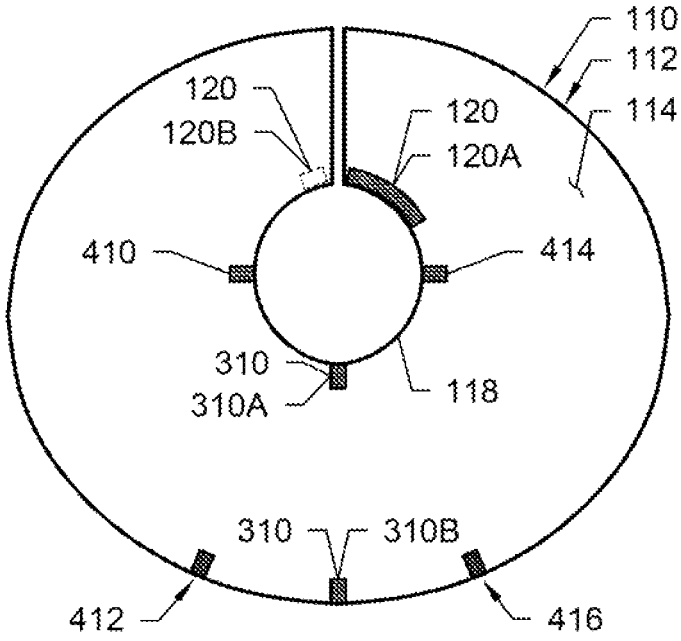
FIG. 4A is a top view of a fourth embodiment of a caregiver cover.

FIG. 4A is a top view of a fourth embodiment of a caregiver cover. This embodiment as described in the first embodiment, FIG. 1A through FIG. 1I, contains body 110 with a stretched torus or other like shape covering chest, shoulders, upper arms, and upper back of caregiver may have double layer 112 with top panel 114 and bottom panel 116; elongated open or closed shaped neck opening 118 included within body 110 may be a circle, oval, crewneck, boat-neck, V-neck, or other like shape. Neck fastener 120 having of female neck fastener 120A component and male neck fastener 120B component for holding the cover around a caregiver may be joined to body 110. As discussed in FIG. 1A, stretched torus or other like shaped body 110 may be extended to provide additional coverage of the upper torso and arms of a caregiver. Please refer to FIG. 1A through FIG. 1F for views of how this embodiment may look when the fasteners are not engaged as the views may be substantially similar.

The fourth embodiment has central fastener 310 which may have upper fastener 310A component and lower fastener 310B component made of a hook and loop, snap, button, cloth tie, magnet, or other like type. Although this embodiment is not limited to how central fastener 310 may be attached, it may be stitched or otherwise joined onto body 110. The fourth embodiment has additional non-central fasteners such as upper left fastener 410 component, upper right fastener 414 component, lower left fastener 412 component, and lower right fastener 416 component of a hook and loop, snap, button, cloth tie, magnet, or other like type joined to body 110. Consistent with lower fastener 310B that may include lower interior fastener 310C component and lower exterior fastener 310D component as shown in FIG. 3E and FIG. 3F; lower left fastener 412 component and lower right fastener 416 component may have a lower interior fastener component and a lower exterior fastener component. Please refer to FIG. 3E and FIG. 3F to see a respective exploded view and an assembled view of a lower interior fastener component and a lower exterior fastener component.

If the hook portion is soft enough that it does not need to be covered, then lower fastener 310B component, lower left fastener 412 component, and lower right fastener 416 component may simply be a hook fastener face up to engage with the upper loop fastener component when the caregiver needs to engage the fasteners. A fastener like OMNI-TAPE brand fastener may be used where the hook and loop may be woven on the same surface and so upper fastener component and lower fastener component may be of the same material.

Lower left fastener 412 component, lower fastener 310B component, and lower right fastener 416 component may be engaged with upper left fastener 410 component, upper fastener 310A component, or upper right fastener 414 component. Although this embodiment is not limited to how upper left fastener 410 component, lower left fastener 412 component, upper right fastener 414 component, and lower right fastener 416 component may be attached they may be stitched or otherwise joined onto body 110.

Figure 5A:
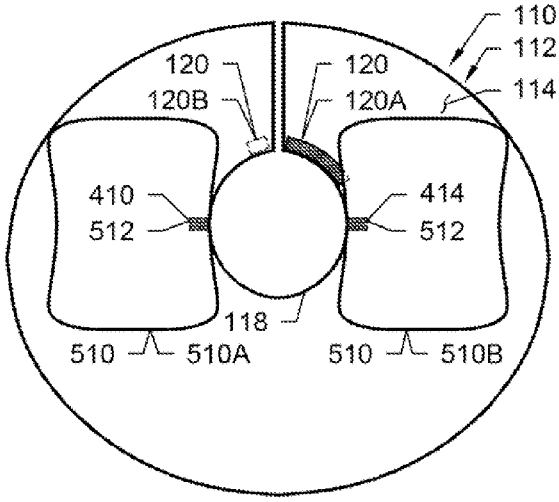
FIG. 5A is a top view of a fifth embodiment of a caregiver cover.

FIG. 5A is a top view of a fifth embodiment of a caregiver cover. This embodiment as described in the first embodiment, FIG. 1A through FIG. 1I, contains body 110 with a stretched torus or other like shape covering chest, shoulders, upper arms, and upper back of a caregiver may be double layer 112 with top panel 114 and bottom panel 116; elongated open or closed shaped neck opening 118 included within body 110 may be a circle, oval, crewneck, boat-neck, V-neck, or other like shape. Neck fastener 120 having female neck fastener 120A component and male neck fastener 120B component, for holding the cover around a caregiver may be joined to body 110. As discussed in FIG. 1A, stretched torus or other like shaped body 110 may be extended to provide additional coverage of the upper torso and arms of a caregiver. Please refer to FIG. 1A through FIG. 1F for views of how this embodiment may look worn on a caregiver as the views may be substantially similar.

The fifth embodiment has upper left fastener 410 component and upper right fastener 414 component. Upper left fastener 410 component and upper right fastener 414 component may be used with burp cloth fastener 512 to removably join burp cloth 510, such as left burp cloth 510A and right burp cloth 510B to body 110. Upper left fastener 410 component and upper right fastener 414 component may be stitched, attached or otherwise joined to body 110. Although detachable burp cloth 510 is not limited to the type of material which may be used, burp cloth 510 may be constructed from an absorbent fabric material such as a flannel, terry cloth, knit, or any combination thereof. Detachable burp cloth 510 may also be of disposable material. In addition, although detachable burp cloth 510 is not limited to an exact shape, a slightly hourglass like shape that compliments the caregiver cover and covers the area with the greatest likelihood of the baby soiling such as a portion of the upper chest, shoulders, and upper back of the caregiver may be used.

Burp cloth fastener 512 component may be stitched or otherwise joined into detachable burp cloth 510 and burp cloth fastener 512 component may be used to removably fasten burp cloth 510 to upper left fastener 410 component or upper right fastener 414 component. Upper left fastener 410 component and upper right fastener 414 component may be stitched or otherwise joined on body 110 of the caregiver cover. Upper left fastener 410 component, upper right fastener 414 component, and burp cloth fastener 512 component may be a hook and loop fastener, snap, button, cloth tie, magnet, zipper, or other like type.

Burp cloth 510 may be removably attached on either side of reversible body 110 of the caregiver cover. If it is desirable burp cloth 510 may be attached, stitched or otherwise joined to body 110 of the caregiver cover rather than removably attached.

Figure 5B:
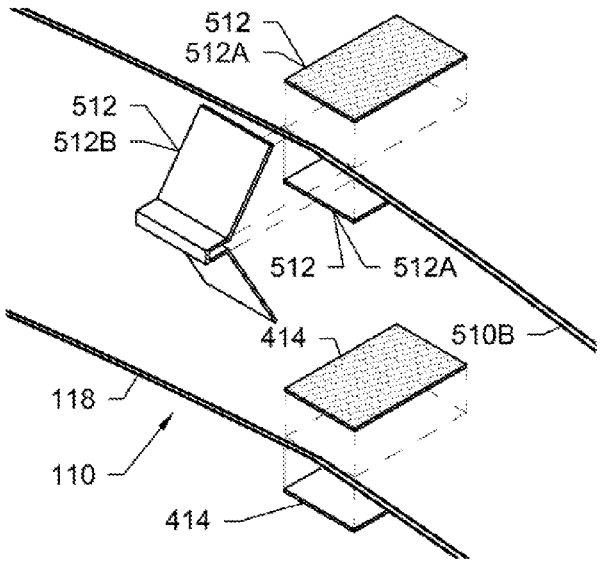
FIG. 5B is an exploded view of a burp cloth interior fastener component and a burp cloth exterior fastener component of a burp cloth fastener of the fifth embodiment of a caregiver cover.

FIG. 5B is an exploded view of burp cloth interior fastener 512A component and burp cloth exterior fastener 512B component of burp cloth fastener 512 of the fifth embodiment of a caregiver cover. Burp cloth fastener 512 component may be burp cloth interior fastener 512A component and burp cloth exterior fastener 512B component so burp cloth 510 may be fastened to an upper fastener located near neck opening 118 of body 110 of a caregiver cover. Burp cloth fastener 512 component may be hook and loop fastener, snap, button, cloth tie, magnet, zipper, or other like type and may be stitched or otherwise attached on burp cloth 510 as discussed in FIG. 5A.

If a hook and loop or other like type fastener is used and it is desirable to have only the soft, loop side face up, burp cloth fastener 512 component may have burp cloth interior fastener 512A component and burp cloth exterior fastener 512B component. Burp cloth interior fastener 512A component may be constructed by the soft, loop portion face up and burp cloth exterior fastener 512B may be constructed of the hook portion face down. When the caregiver needs to attach burp cloth 510, burp cloth exterior fastener 512B component may be detached from burp cloth interior fastener 512A component and may be connected to upper left fastener 410 component or upper right fastener 414 component. If the hook portion is soft enough that it does not warrant the need to be covered, then burp cloth fastener 512 component may have one hook fastener face up to fasten with upper left fastener 410 component or upper right fastener 414 component. A fastener like OMNI-TAPE® brand fastener may be used where the hook and loop may be woven on the same surface and so upper right fastener 414 component, upper left fastener 410 component, and burp cloth fastener 512 component may be of the same material.

Figure 5C:
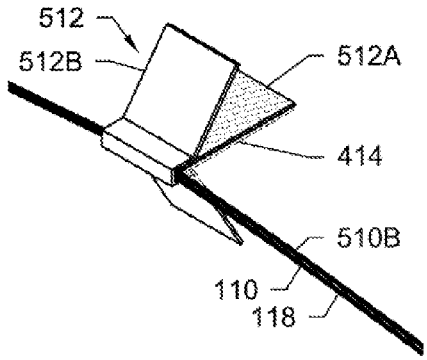
FIG. 5C is an assembled view of a burp cloth interior fastener component and a burp cloth exterior fastener component of a burp cloth fastener of the fifth embodiment of a caregiver cover.

FIG. 5C is an assembled view of burp cloth interior fastener 512A component and burp cloth exterior fastener 512B component of burp cloth fastener 512 of the fifth embodiment of a caregiver cover. Burp cloth fastener 512 component may be burp cloth interior fastener 512A component and burp cloth exterior fastener 512B component which may be stitched or otherwise joined to right burp cloth 510B. Burp cloth 510 may be fastened to body 110 of a caregiver cover by fastening burp cloth 510 it to an upper fastener such as upper right fastener 414.

Figure 6A:
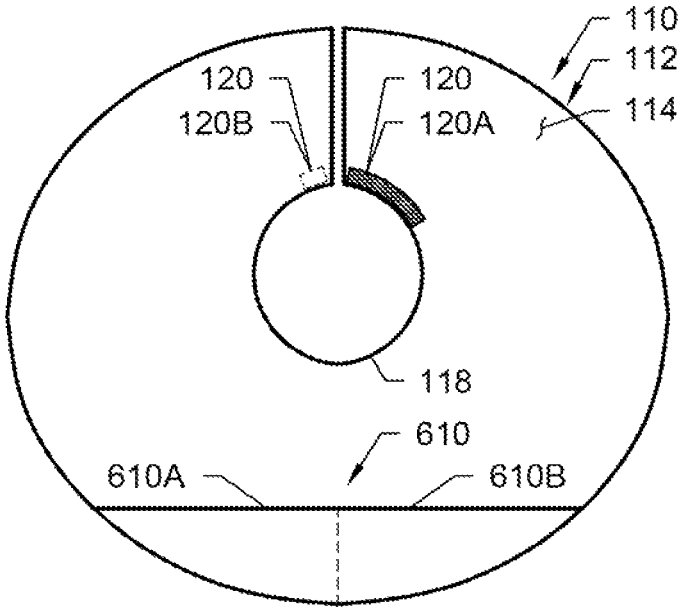
FIG. 6A is a top view of a sixth embodiment of a caregiver cover.

FIG. 6A is a top view of a sixth embodiment of a caregiver cover. This embodiment as described in the first embodiment, FIG. 1A through FIG. 1I, contains body 110 with a stretched torus or other like shape covering chest, shoulders, upper arms, and upper back of a caregiver and may be double layer 112 with top panel 114 and bottom panel 116; elongated open or closed shaped neck opening 118 included within body 110 may be a circle, oval, crewneck, boat-neck, V-neck, or other like shape; and neck fastener 120 may have female neck fastener 120A component and male neck fastener 120B component, for holding the cover around the caregiver. As discussed in FIG. 1A, stretched torus or other like shaped body 110 may be extended to provide additional coverage of the upper torso and arms of the caregiver. Please refer to FIG. 1A through FIG. 1F for views of how this embodiment may look worn on a caregiver as the views may be substantially similar.

The sixth embodiment contains pocket 610. Although this embodiment is not limited to the type of material which may be used, pocket 610 may be of a fabric such as terry cloth, flannel, knit, or the like type. In addition, although it is not limited to the shape, this embodiment shows a pocket with a substantially curved lower edge located at the lower end of a caregiver cover. A different shape of pocket 610 may be located elsewhere on the caregiver cover. Pocket 610 may be located on either top panel 114, bottom panel 116, and/or on both top panel 114 and bottom panel 116. Pocket 610 may be divided into left pocket 610A and right pocket 610B.

FIG. 7A is a top view of a seventh embodiment of a caregiver cover. As described in the first embodiment, FIG. 1A through FIG. 1I, the present embodiment may have body 110 having double layer 112 with a stretched torus or other like shape covering chest, shoulders, upper arms, and upper back of a caregiver; elongated open or closed shaped neck opening 118 included within body 110 may be a circle, oval, crew-neck, boat-neck, V-neck (shown in FIG. 10A), or other like shape. Neck fastener 120 with female neck fastener 120A and male neck fastener 120B may be joined to body 110 for holding cover around a caregiver's neck. As discussed in FIG. 1A, stretched torus or other like shaped body 110 may be extended to provide additional coverage of the upper torso and arms of the caregiver.

As described in FIG. 2A-2D, the present embodiment may have a panel dissected into an upper panel and a lower panel included within body 110. Top panel 114 may be dissected into top upper panel 210 and top lower panel 212 and bottom panel 116 may be dissected into bottom upper panel 214 and bottom lower panel 216. Bottom upper panel 214 may be essentially a mirror image of top upper panel 210. Bottom lower panel 216 may be essentially a mirror image of top lower panel 212 as shown in FIG. 2C. Top upper panel 210, which may have a stretched torus with a substantially straight lower edge, may overlap top lower panel 212, which may have a substantially curved lower edge. Top upper panel 210 may be fastened to top lower panel 212 with top panel fastener 218. Underneath top upper panel 210 may be bottom upper panel 214 and underneath top lower panel 212 may be bottom lower panel 216. Bottom upper panel 214 may overlap bottom lower panel 216 as shown in FIG. 2C and bottom upper panel 214 may be fastened to bottom lower panel 216 with bottom panel fastener 220. Top lower panel 212 and bottom lower panel 216 may form internal pocket 222. Internal pocket 222 may be fastened with internal fastener 224. Top panel fastener 218, bottom panel fastener 220, and internal fastener 224 may be located in several locations as depicted on FIG. 2B and/or may be of sufficient length to be located in only one location as shown in FIG. 7A. Refer to FIG. 2A for a front perspective view of how this embodiment may look while in use by a mother with a breastfeeding baby with top upper panel 210 and bottom upper panel 214 (shown in FIG. 2C) separated from top lower panel 212 and bottom lower panel 216 (shown in FIG. 2C). Refer to FIG. 1A through FIG. 1F for views of how this embodiment may look when top upper panel 210 and bottom upper panel 214 are not separated from top lower panel 212 and bottom lower panel 216 as the views may be substantially similar.

Figure 7B:
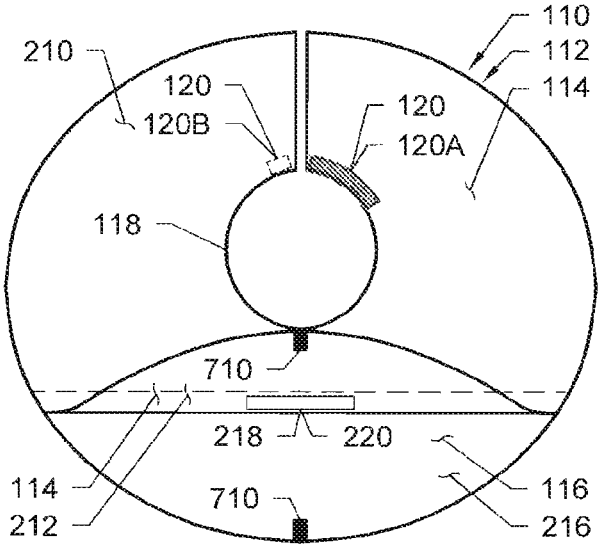
FIG. 7B is the top view of the seventh embodiment of a caregiver cover.

Body 110 may contain the panels in the following order: top upper panel 210 which overlaps top lower panel 212; top lower panel 212 may be directly above bottom lower panel 216 with bottom upper panel 214 on the very bottom and all four panels fastened, joined and/or stitched together in that order similarly to what is shown in FIG. 2C. Top upper panel 210 may be fastened to top lower panel 212 with top panel fastener 218. Top panel fastener 218 may be stitched, attached, or otherwise joined to top upper panel 210 and top lower panel 212. Bottom upper panel 214 may be fastened to bottom lower panel 216 with bottom panel fastener 220. Bottom panel fastener 220 may be stitched, attached, or otherwise joined to bottom upper panel 214 and bottom lower panel 216. Top lower panel 212 and bottom lower panel 216 may form internal pocket 222 (shown in and FIG. 2B and FIG. 7A). Internal pocket 222 may be fastened with internal fastener 224. Alternatively, top upper panel 210 and bottom upper panel 214 may be adhered, joined, or stitched together along with the upper portion of top lower panel 212 and the upper portion of bottom lower panel 216. The lower section of top lower panel 212 and the lower section of bottom lower panel 216 may not be adhered, joined, or stitched together as shown in FIG. 7B. Either allows top lower panel 212 and/or bottom lower panel 216 to be adjusted or pulled up with central fastener 310.

Since top lower panel 212 and bottom lower panel 216 may or may not be stitched or otherwise joined to form internal pocket 222 pocket 610 may be added. Top upper panel 210 may be fastened to top lower panel 212 with top panel fastener 218. Bottom upper panel 214 may be fastened to bottom lower panel 216 with bottom panel fastener 220. Top lower panel 212 and bottom lower panel 216 may be fastened together with internal fastener 224 and lower panel fastener 710 (shown in FIG. 7B). Lower panel fastener 710 may be located on the bottom surface of top lower panel 212 and on the top surface of bottom lower panel 216 and is not shown in FIG. 7A for clarity purposes.

Top panel fastener 218, bottom panel fastener 220, internal fastener 224, lower panel fastener 710, and central fastener 310 may be a hook and loop fastener, snap, button, cloth tie, magnet, zipper, or other like type. Top lower panel 212 and/or the bottom lower panel 216 may be pulled up or adjusted with central fastener 310. In addition, top panel fastener 218 and bottom panel fastener 220 may be used to fasten to the 310 central fastener including 310A upper fastener and 310B lower fastener. Top upper panel 210 and bottom upper panel 214 may be removably unfastened from top lower panel 212 and bottom lower panel 214, therefore, top panel fastener 218 and bottom panel fastener 220 located on top upper panel 210 and bottom upper panel 214 may be used to fasten to the 310 central fastener including upper fastener 310A. The illustration of the use of the top panel fastener 218 and bottom panel fastener 220 acting as a central fastener with central fastener 310A would be substantially similar to those shown in FIG. 3A-3G. There may be multiple top panel fasteners and/or bottom panel fasteners and/or the panel fasteners may be wide enough to substantially fasten the upper panels to the lower panels to prevent gaping of the panels. Top panel fastener 218 may include female top panel fastener 218 component on the bottom surface of top upper panel 210 and male top panel fastener 218 component on the top surface of top lower panel 212. Internal fastener 224 may be located directly below top panel fastener 218 and may include female internal fastener 224 component on the bottom surface of top lower panel 212 and male internal fastener 224 component on the top surface of bottom lower panel 216. Bottom panel fastener 220 may be located directly below internal fastener 224 and may include female bottom panel fastener 220 on the top surface of bottom upper panel 214 and male bottom panel fastener 220 component on the bottom surface of bottom lower panel 216.

As discussed in FIG. 3A central fastener may be made of a hook and loop, snap, button, cloth tie, magnet, or other like type and may be attached to body 110. Central fastener 310 may be female upper fastener 310A component and male lower fastener 310B component. Lower panel fastener 710 may include female lower panel fastener 710 component on the bottom of top lower panel 212 and male lower panel fastener 710 component on top of the bottom lower panel 216. A fastener like OMNI-TAPE® brand fastener may be used where the hook and loop may be woven on the same surface and so technically the female component of the fastener may be substantially the same as the male component of the fastener. The fasteners and fastener components may be stitched or otherwise adhered or joined to their respective panels.

Another example of how the present embodiment may be connected together, not shown, may be top upper panel 210 may be on top of bottom upper panel 214 which may be on top of top lower panel 212 which may be on top of bottom lower panel 216 with the panels joined in that order. Either example may have the same outcome of both top upper panel 210 and bottom upper panel 214 overlapping top lower panel 212 and bottom lower panel 216 and top lower panel 212 and bottom lower panel 216 may still form internal pocket 222; the only difference is the order in which the panels may be connected together. The panels may be removably fastened, stitched or otherwise adhered or joined to one another. Top upper panel 210 may go on top of bottom upper panel 214 and those panels may be stitched or otherwise joined together rather than using a panel fastener and then a panel fastener may be used to fasten top upper panel 210 and bottom upper panel 214 to top lower panel 212 and bottom lower panel 216. Bottom upper panel 214 may be excluded (FIG. 8A) and top upper panel 210 may be used with a top lower panel 212 and a bottom lower panel 216. Top lower panel 212 and bottom lower panel 216 may still use an internal fastener 224 to fasten top lower panel 212 and bottom lower panel 216. Top lower panel 212 and bottom lower panel 216 may be partially adhered, stitched or otherwise joined, thereby maintaining internal pocket 222 or the bottom panels may be stitched, adhered or otherwise joined together thereby eliminating internal pocket 222; either allows top lower panel 212 and/or bottom lower panel 216 to be pulled up or adjusted-with central fastener 310.

Another example of how the present embodiment may be produced, not shown in the figures, may be to adhere, join, or stitch the upper portion of top panel 114 and the upper portion of bottom panel 116 and then dissect the panels by cutting a slit or other like method to create an opening in each panel thereby top panel 114 may have top upper panel 210 and top lower panel 212 and bottom panel 116 may have bottom upper panel 214 and bottom lower panel 216. Top lower panel 212 or bottom lower panel 216 may still be pulled up or adjusted with central fastener 310.

The seventh embodiment may have top panel 114 not dissected into top upper panel 210 and top lower panel 212. The top panel 114 may still have central fastener 310. The bottom panel 116 may be dissected into bottom upper panel 214 and bottom lower panel 216.

FIG. 7B is a top view of the seventh embodiment of a caregiver cover which illustrates top lower panel 212 being held up with central fastener 310. Since top lower panel 212 and bottom lower panel 216 may or may not be stitched or otherwise joined to form internal pocket 222 top upper panel 210 may be fastened to top lower panel 212 with top panel fastener 218. Bottom upper panel 214 may be fastened to bottom lower panel 216 with bottom panel fastener 220. Top lower panel 212 and bottom lower panel 216 may be fastened together with internal fastener 224 and lower panel fastener 710. Lower panel fastener 710 may be located on the bottom surface of top lower panel 212 and on the top surface of bottom lower panel 216. Top lower panel 212 may be detached from lower panel fastener 710 and lower fastener 310B of the central fastener 310 is fastened to upper fastener 310A of central fastener. Central fastener 310 including upper fastener 310A and lower fastener 310B are not shown in the figure for clarity. Internal fastener 224 is also not shown in this figure for clarity. The top lower panel 212 upper edge and the bottom lower panel 216 upper edge may be stitched or otherwise joined together therefore the caregiver cover may not need the internal fastener 224.

Figure 8A:
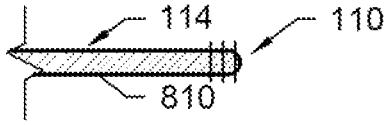
FIG. 8A is a section view of an eighth embodiment of a caregiver cover.

FIG. 8A is a section view of FIG. 1G and FIG. 1H of an eighth embodiment of a caregiver cover. This embodiment as described in the first embodiment, FIG. 1A through FIG. 1I, contains body 110 with a stretched torus or other like shape covering chest, shoulders, upper arms, and upper back of a caregiver; elongated open or closed shaped neck opening 118 included within the body may be a circle, oval, crewneck, boat-neck, V-neck, or other like shape; and a neck fastener 120 may fasten cover around the caregiver. As discussed in FIG. 1A, stretched torus or other like shaped body 110 may be extended to provide additional coverage of the upper torso and arms of a caregiver. Please refer to FIG. 1A through FIG. 1F for views of how this embodiment may look worn on a caregiver and FIG. 1G and FIG. 1H for a respective top view and bottom view as the views may be substantially similar to the view of the eighth embodiment.

FIG. 8A illustrates a section view of a single layer 810 taken from FIG. 1G and FIG. 1H with FIG. 1G and FIG. 1H having single layer 810. A caregiver cover may only have top panel 114 of fabric. Other than single layer 810 of the eighth embodiment versus double layer 112 of the first embodiment, the eighth embodiment may have the same elements as the first embodiment.

Like the first embodiment the eighth embodiment is not limited to the type of material which may be used, top panel 114 may be a soft, comfortable absorbent fabric such as terry cloth, flannel, knit, or other like material. Single layer 810 of fabric may be stitched on the edge or a binding may be attached or stitched to avoid unraveling of the fabric. The caregiver cover may be reversible and either side of top panel 114 of the cover may be worn outwardly on the caregiver. The reversible option is not required.

Figure 9A:
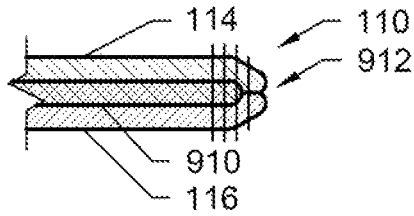
FIG. 9A is a section view of a ninth embodiment of a caregiver cover.

FIG. 9A is a section view of FIG. 1G and FIG. 1H of a ninth embodiment of a caregiver cover. This embodiment as described in the first embodiment, FIG. 1A through FIG. 1I, contains body 110 with a stretched torus or other like shape covering chest, shoulders, upper arms, and upper back of a caregiver; elongated open or closed shaped neck opening 118 included within body 110 may be a circle, oval, crewneck, boat-neck, V-neck, or other like shape; and a neck fastener 120 for holding the cover around a caregiver. As discussed in FIG. 1A, stretched torus or other like shaped body 110 may be extended to provide additional coverage of the upper torso and arms of a caregiver. Please refer to FIG. 1A through FIG. 1F for views of how this embodiment may look worn on a caregiver and FIG. 1G and FIG. 1H for a respective top view and a bottom view as the views may be substantially similar to the view of the ninth embodiment.

The ninth embodiment illustrates a section view as taken from FIG. 1G and FIG. 1H with FIG. 1G and FIG. 1H having triple layer 912. The ninth embodiment has body 110 including top panel 114, bottom panel 116, and middle panel 910 sandwiched between top panel 114 and bottom panel 116 creating a triple layer 912. A caregiver cover is not limited to a certain number of layers; this embodiment simply shows how a multiple layer caregiver cover may be created. Although this embodiment is not limited to the type of material which may be used, top panel 114 and bottom panel 116 may be constructed from a soft, comfortable, absorbent fabric such as terry cloth, flannel, knit, or other like material. Middle panel 910 may be filler like padding such as a soft batting; a fabric such as an absorbent fabric such as terry cloth, flannel, knit or other like fabric; or a water impervious material like nylon. Although this embodiment is not limited to how top panel 114, middle panel 910, and bottom panel 116 may be connected to each other, top panel 114, middle panel 910, and bottom panel 116 may be stitched or otherwise joined together.

Middle panel 910 does not have to be a mirror image of top panel 114 and bottom panel 116. For example, middle panel 910 may be designed with a stretched torus with a substantially straight or generally linear lower edge shape like a top upper panel 210 shown in FIG. 2C rather than stretched torus or other like shape of top panel 114 and bottom panel 116.

Figure 10A:
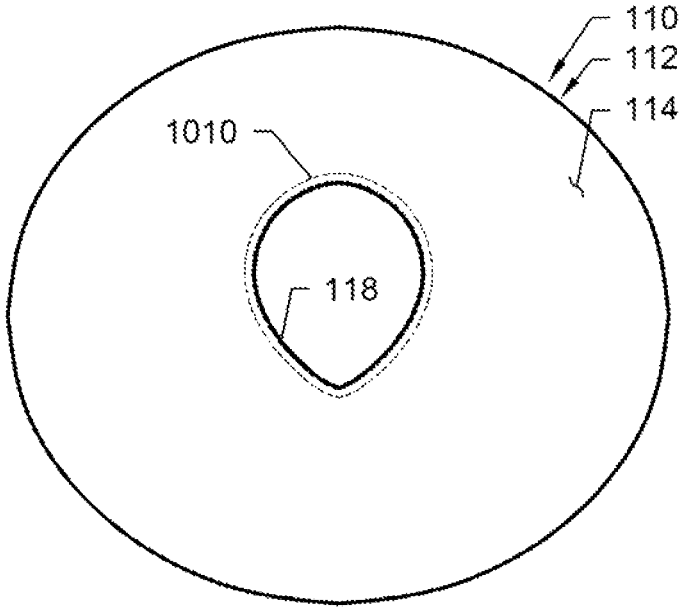
FIG. 10A is a top view of a tenth embodiment of a caregiver cover.

FIG. 10A is a top view of a tenth embodiment of a caregiver cover. This embodiment as described in the first embodiment, FIG. 1A through FIG. 1I, contains a body 110 with a stretched torus or other like shape covering chest, shoulders, upper arms, and upper back of a caregiver may be double layer 112 with top panel 114 and bottom panel 116; elongated open or closed shaped neck opening 118 with a circle, oval, crewneck, boat-neck, or V-neck included within the body 110. Neck opening 118 in FIG. 10A depicts an example of a V-neck opening only in the front of the caregiver cover. Neck opening 118 may also be a V-neck in the back of the neck opening (not shown). As discussed in FIG. 1A, stretched torus or other like shaped body 110 may be extended to provide additional coverage of the upper torso and arms of a caregiver. Please refer to FIG. 1A through FIG. 1F for views of how this embodiment may look worn on the caregiver as the views may be substantially similar.

As shown in FIG. 10A this present embodiment neck opening 118 may be closed and therefore may not need neck fastener 120. The present embodiment may have flat collar 1010 joined to body 110. Collar 1010 may be a flexible material such as a ribbed knit or other like material.

The additional embodiments illustrate additional features that may be incorporated in the versatile caregiver cover designed to adequately cover the chest, shoulders, upper arms, and upper back of a caregiver to protect the caregiver's clothes from becoming soiled during the care of the baby such as when burping, holding, bathing, and other like uses when caring for a baby; and/or to provide adequate coverage for the nursing mother so she may maintain privacy while nursing without fully covering her baby; and/or to provide a comfortable surface for the baby while eating, burping, teething, being carried, or the like. As one of skill in the art will appreciate, features described herein may be used in many combinations to provide the caregiver cover according to the present invention.

FIG. 2A illustrates the second embodiment of a caregiver cover while in use by a mother with a breastfeeding baby nursing essentially on the outside of the cover. FIG. 2A, FIG. 2B, and FIG. 2C illustrate how top panel 114 may be dissected into top upper panel 210 and top lower panel 212, and bottom panel 116 may be dissected into bottom upper panel 214 and bottom lower panel 216. Top upper panel 210, bottom upper panel 214, top lower panel 212, and bottom lower panel 216 cooperatively function together to allow a nursing mother to be able to open the caregiver cover. Opening the panels allows a mother to see her baby to help position and latch baby; continue to observe, monitor, and bond with baby; and to allow baby to nurse both on the outside and inside of cover while mother has adequate coverage to maintain privacy while simultaneously providing coverage of the shoulders, upper arms, chest, and upper back so a nursing mother can immediately burp her baby on either shoulder or chest area and prevent her clothing from becoming soiled. The top panel fastener 218 joined to body 110 fastens the top upper panel 210 to the top lower panel 212 and the bottom panel fastener 220 joined to body 110 fastens the bottom upper panel 214 to the bottom lower panel 216 thereby removably fastening the panel openings to close the caregiver cover.

The second embodiment not only provides full privacy for the nursing mother while partially covering a breastfeeding baby but it also provides full privacy while the baby is essentially uncovered. Allowing the baby to be partially covered or essentially uncovered prevents the baby from becoming overheated and is usually preferred by most babies.

The second embodiment allows a nursing mother to be able to nurse a baby both on the inside of the cover and outside of the cover depending on the mother's and baby's preference. A mother may want to nurse on the inside of the cover if the mother wants additional privacy or if the mother wants to shield her baby from the sun or outside distractions; but, the mother may want to breastfeed her baby on the outside of the cover so she can fully observe, monitor, and bond with her baby. A baby may prefer to breastfeed on the outside of a cover as the baby may not like to be covered or may become overheated while being fully covered during breastfeeding.

The second embodiment not only has nursing benefits but also provides protection of the caregiver's clothes from becoming soiled during the care of the baby such as when burping, holding, bathing, or other like uses. Top upper panel 210 and bottom upper panel 214 may have a stretched torus with a substantially straight lower edge which overlap top lower panel 212 and bottom lower panel 216 which may have a substantially curved lower edge. When top upper panel 210 is fastened to top lower panel 212 with top panel fastener 218 and bottom upper panel 214 is fastened to bottom lower panel 216 with bottom panel fastener 220 the panels form the same stretched torus or other like shape with elongated open or closed shaped neck opening 118 which may be a circle, oval, crewneck, boat-neck, V-neck, or other like shape of the caregiver cover so the cover adequately provides coverage of shoulder, upper arms, chest, and upper back of the caregiver therefore a nursing so mother can immediately burp her baby on either shoulder or chest area and still prevent her clothes from becoming soiled.

Top lower panel 212 and bottom lower panel 216 may form internal pocket 222 which may be fastened with internal fastener 224. Internal pocket 222 allows a caregiver to store items small baby items such as additional burp cloths, pacifiers, or other like items. In addition, FIG. 2D shows how the caregiver cover may be folded into internal pocket 222 for ease of transport. A fastener like OMNI-TAPE® brand fastener may be used for top panel fastener 218, bottom panel fastener 220, and internal fastener 224 because with OMNI-TAPE® the hook and loop may be woven on the same surface and thus the hook and loop resist snagging and may be softer than the traditional hook side of hook and loop fasteners.

FIG. 3A demonstrates the third embodiment of a caregiver cover while in use by a nursing mother with a breastfeeding baby nursing on the outside of the cover. FIG. 3A, FIG. 3B, and FIG. 3D illustrate how central fastener 310 joined to body 110 may be fastened to hold the protective cover up so a nursing mother can see her baby to help position and latch baby; continue to observe, monitor, and bond with baby; and to allow baby to nurse both on the outside and inside of cover while mother has adequate coverage to maintain privacy while simultaneously providing coverage of the shoulders, upper arms, chest, and upper back so a nursing mother can immediately burp her baby on either shoulder or chest area and prevent her clothing from becoming soiled. The third embodiment provides adequate coverage for a nursing mother and provides her the option to nurse her baby either on the outside and/or the inside of the caregiver cover.

The third embodiment as shown in FIG. 3C has stretched torus or other like shaped body 110 which may be designed to adequately cover the chest, shoulders, upper arms, and upper back of the caregiver to protect the caregiver's clothes from becoming soiled during normal care of a baby such as burping, holding, or bathing baby; and/or to provide adequate coverage for a nursing mother so she can maintain privacy while nursing without fully covering her baby; and/or to provide a comfortable surface for a baby while eating, burping, teething, being carried, or the like. The third embodiment also allows a mother to be able to see her baby when positioning and latching her baby so she can observe, monitor, and bond with her baby while nursing yet still have adequate coverage when nursing and caring for her baby such as burping and holding her baby.

As shown in FIG. 3G, central fastener 310 may be used to make it easier for a young child to wear the caregiver cover to protect the child's clothes when the child eats thus extending the useful life of a caregiver cover. The baby may wear cover to chew on to provide relief from teething pain and/or to protect baby's clothes when he eats. In addition as shown in FIG. 3H, central fastener 310 may be used to fasten the cover for storage and/or ease of transport in the caregiver's bag.

A fastener like a OMNI-TAPE® brand fastener may be used where the hook and loop may be woven on the same surface and so technically upper fastener 310A and lower fastener 310B component may essentially be the same. OMNI-TAPE® resists snagging and may be softer than the traditional hook and loop fasteners. If a standard hook and loop fastener is used the caregiver cover may be designed to have only the soft loop side facing out and lower fastener 310B component may have lower interior fastener 310C component (shown in FIG. 3E and FIG. 3F) and lower exterior fastener 310D component (shown in FIG. 3E and FIG. 3F). Lower interior fastener 310C component may be constructed by the soft, loop portion face up and the lower exterior fastener 310D component may be constructed of the hook portion face down. Lower interior fastener 310C component and lower exterior fastener 310D component allow a traditional hook and loop fastener to be used with only the soft portion face up allowing the baby to be in contact with the soft side. If the lower interior fastener 310C component and lower exterior fastener 310D component is used, then lower exterior fastener 310D component may be used to possibly hold a pacifier.

FIG. 4A illustrates the fourth embodiment of a caregiver cover. The fourth embodiment has additional fasteners such as upper left fastener 410 component, upper right fastener 414 component, lower left fastener 412 component, and lower right fastener 416 component all of which may be used to hold the caregiver cover up so a nursing mother can see her baby to help position and latch baby; continue to observe, monitor, and bond with baby; and to allow baby to nurse both on the outside and inside of the cover while mother has adequate coverage to maintain privacy while simultaneously providing coverage of the shoulders, upper arms, chest, and upper back so a nursing mother can immediately burp her baby on either shoulder or chest area and prevent her clothing from becoming soiled. The fasteners may also be used to fasten the cover for storage and/or ease of transport in the caregiver's bag.

The additional fasteners provide more options to fasten the cover up and assist a mother with breastfeeding her baby. The caregiver may attach lower left fastener 412 component or other like fasteners to upper left fastener 410 component, upper fastener 310A component, upper right fastener 414 component or other like fasteners. Lower right fastener 416 component may attach to upper right fastener 414 component, upper fastener 310A component, or upper left fastener 410 component. Lower fastener 310B component may attach to upper left fastener 410 component, upper fastener 310A component, or upper right fastener 414 component. If the interior and exterior fasteners are used then they may be able to hold a pacifier or possibly a small toy.

FIG. 5A illustrates a caregiver cover with burp cloths which may removably attach or join to body 110 to provide a detachable layer of protection. Burp cloth 510 may be constructed from an absorbent fabric material such as a flannel, terry cloth, knit; a water impervious material like nylon; or any combination thereof. Burp cloth 510 may also be a disposable material. In addition, although burp cloth 510 is not limited to an exact shape, the shape may be a slightly hourglass like shape that compliments the stretched torus or other like shaped body 110 of the caregiver cover and covers the area with the greatest likelihood of the baby soiling such as a portion of the upper chest, shoulders, and upper back of the caregiver. The detachable burp cloths protect the caregiver cover by limiting the number of times the cover needs to be washed, and the burp cloths further protect the caregiver's clothes.

Detachable burp cloth 510 may have burp cloth fastener 512 component which may be joined or stitched into detachable burp cloth 510 and burp cloth fastener 512 component may be used to fasten to upper left fastener 410 component or upper right fastener 414 component. Upper left fastener 410 component and upper right fastener 414 component may be attached or otherwise stitched on body 110 of a caregiver cover. Upper left fastener 410 component, upper right fastener 414 component, and burp cloth fastener 512 component may be a hook and loop fastener, snap, button, cloth tie, magnet, or other like type.

As shown in FIG. 5B and FIG. 5C, if a hook and loop or other like type fastener is used and it is desirable to have only the soft, loop side face up, burp cloth fastener 512 component may include burp cloth interior fastener 512A component and burp cloth exterior fastener 512B component. Burp cloth interior fastener 512A component may be constructed by the soft, loop portion face up and burp cloth exterior fastener 512B component may be constructed of the hook portion face down to allow the baby to only be in contact with the soft side. If the hook portion is soft enough that it does not warrant the need to be covered, then burp cloth fastener 512 component may have one hook fastener face up to fasten with upper left fastener 410 component or upper right fastener 414 component.

A fastener like OMNI-TAPE® brand fastener may be used where the hook and loop may be woven on the same surface and so upper right fastener 414 component, upper left fastener 410 component, and burp cloth fastener 512 component may be of the same material. Burp cloth 510 may be removably attached or otherwise joined on either side of reversible body 110 of the caregiver cover making detachable burp cloth 510 versatile and easy to use. In addition, burp cloth 510 may be adhered, or otherwise attached to the caregiver cover by stitching burp cloth 510 into body 110 of the cover thereby adding another layer of protection in an area with the most likelihood of becoming soiled.

FIG. 6A illustrates the sixth embodiment of a caregiver cover with the additional feature of pocket 610 with a substantially curved lower edge. A caregiver cover may have pocket 610 on body 110 to store small baby items such as additional burp cloths, wipes, pacifier or other like items. Pocket 610 may be divided into left pocket 610A and right pocket 610B providing the caregiver with more organization for items. If pocket 610 is not divided into compartments, then it may be used to for folding the caregiver cover into it for storage.

FIG. 7A illustrates the seventh embodiment of a caregiver cover. FIG. 7A illustrates how top panel 114 may be dissected into top upper panel 210 and top lower panel 212, and bottom panel 116 may be dissected into bottom upper panel 214 and bottom lower panel 216. Top upper panel 210, bottom upper panel 214, top lower panel 212, and bottom lower panel 216 cooperatively function together to allow a nursing mother to be able to open the caregiver cover. FIG. 7A also illustrates how central fastener 310 can be joined to body 110 to function with or without the upper and lower panels.

Separating the panels or using central fastener 310 allows a mother to see her baby to help position and latch baby; continue to observe, monitor, and bond with baby; and to allow baby to nurse both on the outside and inside of cover while mother has adequate coverage to maintain privacy while simultaneously providing coverage of the shoulders, upper arms, chest, and upper back so the nursing mother can immediately burp her baby on either shoulder or chest area and prevent her clothing from becoming soiled. Top lower panel 212 and bottom lower panel 216 may form internal pocket 222 which may be fastened with internal fastener 224. Internal pocket 222 allows a caregiver to store items small baby items such as additional burp cloths, pacifiers, or other like items. In addition, FIG. 2D shows how the caregiver cover may be folded into internal pocket 222 for ease of transport. A fastener like OMNI-TAPE® brand fastener may be used for top panel fastener 218, bottom panel fastener 220, and internal fastener 224 because with OMNI-TAPE® the hook and loop may be woven on the same surface and thus the hook and loop resist snagging and may be softer than the traditional hook side of hook and loop fasteners.

This present embodiment not only provides full privacy for the nursing mother while partially covering a breastfeeding baby but it also provides full privacy while the baby is essentially uncovered. Allowing the baby to be partially covered or essentially uncovered prevents the baby from becoming overheated and is usually preferred by most babies. In addition in the seventh embodiment top lower panel 212 and bottom lower panel 216 are not completely attached, adhered or stitched together thereby allowing the caregiver to nurse her baby below top upper panel 210 and top lower panel 212 and have full coverage of her baby and/or pull up top lower panel 212 using central fastener 310 so she can see her baby and effectively nurse her baby on the outside of the cover but have the additional feature of releasing top lower panel 212 and immediately fully covering her baby if the need arises. The seventh embodiment may be reversible.

The seventh embodiment allows a nursing mother to be able to nurse the baby both on the inside of the cover and outside of the cover depending on the mother's and baby's preference. A mother may want to nurse on the inside of the cover if the mother wants additional privacy or if the mother wants to shield her baby from the sun or outside distractions; but, the mother may want to breastfeed her baby on the outside of the cover so she can fully observe, monitor, and bond with her baby. A baby may prefer to breastfeed on the outside of a cover as the baby may not like to be covered or may become overheated while being fully covered during breastfeeding. The seventh embodiment also allows a mother to nurse on the outside of the cover with the additional feature of easily unlatching central fastener 310 and essentially converting to nurse the baby on the inside of the cover.

The seventh embodiment not only has additional nursing benefits it also provides protection of the caregiver's clothes from becoming soiled during the care of a baby such as when burping, holding, bathing, or other like uses. Top upper panel 210 and bottom upper panel 214 may have a stretched torus with a substantially straight lower edge which overlaps top lower panel 212 and bottom lower panel 216 which may have a substantially curved lower edge. When top upper panel 210 is fastened to top lower panel 212 with top panel fastener 218 and bottom upper panel 214 is fastened to bottom lower panel 216 with bottom panel fastener 220 the panels form the same stretched torus or other like shape with elongated open or closed shaped neck opening 118 which circle, oval, crew-neck, boat-neck, V-neck, or other like shape of the caregiver cover so it adequately provides coverage of shoulder, upper arms, chest, and upper back of the caregiver after which a nursing so mother can immediately burp her baby on either shoulder or chest area and still prevent her clothes from becoming soiled.

A fastener like OMNI-TAPE® brand fastener may be used for the top panel fastener 218, the bottom panel fastener 220, internal fastener 224, lower panel fastener 710, and central fastener 310; because with OMNI-TAPE® the hook and loop may be woven on the same surface and thus the hook and loop resist snagging and may be softer than the traditional hook side of hook and loop fasteners.

The illustration of the use of the top panel fastener 218 and bottom panel fastener 220 acting as a central fastener with central fastener 310A would be substantially similar to those shown in FIG. 3A-3G. FIG. 7B illustrates the use of top lower panel 212 fastened to central fastener 310. The caregiver may be able to separate bottom upper panel 214 and bottom lower panel 216 to effectively nurse her baby on the outside of the cover and then the caregiver may release the top lower panel 212 from the central fastener if she wants to nurse her baby on the inside of the cover.

FIG. 8A illustrates the eighth embodiment of a caregiver cover with single layer 810 of material. A caregiver cover made with single layer 810 of material may have the same features of double layer 112. Like the first embodiment, the eighth embodiment may have a stretched torus or other like shaped body 110 which may be designed to adequately cover the chest, shoulders, upper arms, and upper back of a caregiver to protect the caregiver's clothes from becoming soiled during normal care of a baby such as burping, holding, or bathing baby; and/or to provide adequate coverage for a nursing mother so she can maintain privacy while nursing without fully covering her baby; and/or to provide a comfortable surface for a baby while eating, burping, teething, being carried, or the like.

All embodiments may be made with the single layer 810 of material. Even the second embodiment may have only one layer. The only difference the second embodiment may have if made of one layer of material may be no internal pocket 222 formed since there may not be a bottom lower panel 216 to form an internal pocket with top lower panel 212. A caregiver cover made with single layer 810 of material requires less material and may seem more similar to the texture of a conventional burp cloth or nursing cover.

FIG. 9A illustrates the ninth embodiment of a caregiver cover made with a triple layer 912 of material for providing additional layer of protection for caregiver's clothes. A caregiver cover made with triple layer 912 of material may have the same features of other embodiments; a stretched torus or other like shaped body 110 which may be designed to adequately cover the chest, shoulders, upper arms, and upper back of a caregiver to protect the caregiver's clothes from becoming soiled during normal care of a baby such as burping, holding, or bathing baby; and/or to provide adequate coverage for a nursing mother so she can maintain privacy while nursing without fully covering her baby; and/or to provide a comfortable surface for a baby while eating, burping, teething, being carried, or the like.

All embodiments may be made with triple layer 912 of fabric with the middle panel 910 sandwiched between top panel 114 and bottom panel 116 of double layer 112 thereby forming triple layer 912. Because middle panel 910 may be a filler like a padding such as soft batting; fabric such as an absorbent terry cloth, flannel, knit or other like fabric; and/or a water impervious material like nylon, middle panel 910 provides another layer of comfort for the baby and also provides an additional layer of protection for the caregiver's clothes. Middle panel 910 does not have to be a mirror image of top panel 114 and bottom panel 116. For example, middle panel 910 may be designed as a stretched torus with a substantially straight lower edge shape like top upper panel 210 shown in FIG. 2C rather than the stretched torus or other like shape of top panel 114 and bottom panel 116. Middle panel 910 may be designed to only be located in areas of greatest likelihood of the baby soiling such as a portion of the upper chest, shoulders, and upper back of the caregiver and/or areas to provide additional padding for the baby.

FIG. 10A illustrates a caregiver cover with neck opening 118 closed and flat collar 1010 joined to body 110. Elongated open or closed shaped neck opening 118 included within body 110 may be a circle, oval, crewneck, boat-neck, V-neck, or other like shape. Neck opening 118 in FIG. 10A depicts an example of a V-neck only in the front of the caregiver cover. Neck opening may also be a V-neck on the back of the neck opening (not shown). A V-neck opening, boat-neck, or other like opening may allow a caregiver to peak in to help position and latch baby.

Neck opening 118 may be of sufficient size for various sized caregivers while minimizing unprotected exposure. Material used for neck opening 118 may be flexible to allow the various sized caregivers to easily pull the caregiver cover over his head. Collar 1010 may be a flexible material such as a ribbed knit or other like material to allow caregiver cover to be worn on various sized caregivers. Collar 1010 may be added to any of the embodiments even when neck fastener 120 is used.

As one of skill in the art will appreciate, features described may be used in many combinations to provide a caregiver cover according to the present invention. Caregiver cover may have body 110 with stretched torus, circle, flat ellipse, or other like shape. The caregiver cover may be a soft, comfortable, absorbent fabric, such as terry cloth, flannel, knit, or other like material; and/or a water impervious material like nylon. The caregiver cover may be reversible. Neck opening 118 integrated, incorporated, or otherwise included within body 110 may have an open or closed shape. Neck opening 118 may form a non-concentric circle with body 110. Neck opening 118 may have collar 1010 integrated, included, stitched, attached, or otherwise joined to body 110. If neck opening 118 has open shape then neck fastener 120 for holding cover around caregiver's neck may be integrated, included, stitched, attached, or otherwise joined to body 110. If neck opening 118 has closed shape then caregiver cover may be pulled over caregiver's head.

All embodiments may have upper panel and/or lower panel such as top upper panel 210, top lower panel 212, bottom upper panel 214, and/or bottom lower panel 216 integrated, or otherwise included within body 110. Panel fasteners such as top panel fastener 218 and bottom panel fastener 220 for removably fastening top upper panel 210 to top lower panel 212 and/or bottom upper panel 214 to bottom lower panel 216 may be integrated, included, stitched, attached, or otherwise joined to body 110. An internal pocket 222 may be integrated, or otherwise included within body 110.

Central fastener 310 and/or additional non-central fasteners may be integrated, included, stitched, attached, or otherwise joined to body 110 of any of the embodiments. Any embodiment may have burp cloth 510 removably joined to body 110 using burp cloth fastener 512. Burp cloth fastener 512 may be integrated, included, stitched, attached, or otherwise joined to burp cloth 510. Pocket(s) 610 may be integrated, included, stitched, attached, joined, or otherwise on body 110 of any embodiments. All embodiments may have body 110 include single layer 810; double layer 112 with top panel 114 and bottom panel 116; triple layer 912 with top panel 114, bottom panel 116, and middle panel 910; or multiple layers.

All fasteners such as neck fastener 120, panel fasteners, internal fastener 224, central fastener 310, non central fasteners, burp cloth fastener 512, and other like fasteners; pocket 610, and collar 1010 may be directly or indirectly integrated, included, stitched, attached, or otherwise joined to body 110. All fasteners may be hook and loop fastener, snap, button, cloth tie, magnet, zipper, or other like type. All elements of body 110 including single layer 810, top panel 114, bottom panel 116, neck opening 118, neck fastener, 120, collar 1010, upper panel, lower panel, panel fastener, central fastener 310, non-central fastener, double layer 112, middle panel 910, triple layer 912, multiple layers, burp cloth 510, burp cloth fastener 512, pocket 610, internal pocket 222, internal fastener 224, and other like elements may be integrally formed. Other modifications such as adding a loop for hanging caregiver cover may be done to body 110.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Having thus described the invention, what is desired to be protected by Letters Patent is presented in the subsequently appended claims.

What is claimed is:

1. A caregiver cover for providing adequate coverage when caring for a baby, comprising:

(a) a stretched flat torus body comprising an upper panel and a lower panel, said upper panel being of sufficient length to cover chest, shoulders, upper arms, and upper back of a caregiver;

(b) said upper panel having a circular shaped neck opening included within said upper panel, wherein said neck opening has at least one characteristic selected from the following group: a neck fastener joined to said body, and a closed shape;

(c) said upper panel comprising a substantially straight lower edge having a releasable panel fastener integrated to said upper panel's substantially straight lower edge;

(d) said lower panel comprising a substantially straight upper edge and a substantially curved lower edge, said substantially straight upper edge of said lower panel having a releasable panel fastener integrated to said substantially straight upper edge for fastening said upper panel to said lower panel to form the stretched flat torus body;

(e) said panel fasteners align horizontally and fasten together to position said upper panel lower edge vertically over said lower panel upper edge to provide additional length of said caregiver cover.

2. The caregiver cover as recited in claim 1, wherein said body has at least one characteristic selected from the following group: fabric and reversible.

3. The caregiver cover as recited in claim 1, further comprising: a central fastener joined to a lower edge of said neck opening to vertically adjust said body to allow varied lengths of the caregiver cover.

4. The caregiver cover as recited in claim 1, wherein said lower panel comprises a top lower panel and a bottom lower panel which overlap to form the lower panel, thereby forming an integrated internal pocket included within said body.

5. The caregiver cover as recited in claim 1, further comprising:

a non-central fastener joined to a left or right side of said neck opening to vertically adjust said body to allow varied lengths of the caregiver cover.

6. The caregiver cover as recited in claim 1, further comprising:

an additional panel forming a double layer included within said body functioning to provide additional absorption or comfort.

7. The caregiver cover as recited in claim 6, further comprising:

a middle panel sandwiched to said double layer, and included within said body functioning to provide additional absorption or comfort.

8. The caregiver cover as recited in claim 5, further comprising:

a burp cloth with a burp cloth fastener to fasten to said non-central fastener on said upper panel.

9. The caregiver cover as recited in claim 1, further comprising:

a pocket on said body.

10. The caregiver cover as recited in claim 1, further comprising:

a collar joined to said body.

11. The caregiver cover as recited in claim 1 wherein the releasable panel fasteners are selected from the group consisting of: hook and loop fasteners, snaps, buttons, cloth ties, magnets, and zippers.

12. The caregiver cover as recited in claim 3 further comprising a fastener joined to the lower edge of the lower panel which can be fastened to said central fastener to vertically adjust said body to allow varied lengths of the caregiver cover.

13. A caregiver cover for providing adequate coverage when caring for a baby, comprising:

(a) a stretched flat torus body comprising an upper panel and a lower panel, said upper panel being of sufficient length to cover chest, shoulders, upper arms, and upper back of a caregiver, said upper panel functions independently to provide coverage for said caregiver;

(b) said upper panel having a circular shaped neck opening included within said upper panel, wherein said neck opening has at least one characteristic selected from the following group: a neck fastener joined to said body, and a closed shape;

(c) said upper panel comprising a substantially straight lower edge having a releasable panel fastener integrated to said upper panel's substantially straight lower edge;

d) said lower panel comprising a substantially straight upper edge and a substantially curved lower edge, said substantially straight upper edge of said lower panel having a releasable panel fastener integrated to said substantially straight upper edge for fastening said upper panel to said lower panel to form the stretched flat torus body;

(e) said panel fasteners align horizontally and fasten together to position said upper panel with a vertical overlap over said lower panel with said lower panel extending lower than said upper panel to provide additional length of said caregiver cover; said upper panel fully unfastens from said lower panel.

14. The caregiver cover as recited in claim 13, wherein said body has at least one characteristic selected from the following group: fabric and reversible.

15. The caregiver cover as recited in claim 13, further comprising: a central fastener joined to a lower edge of said neck opening to vertically adjust said body to allow varied lengths of the caregiver cover.

16. The caregiver cover as recited in claim 13, wherein said lower panel comprises a top lower panel and a bottom lower panel which overlap to form the lower panel, thereby forming an integrated internal pocket included within said body.

17. The caregiver cover as recited in claim 13, further comprising:

an additional panel forming a double layer included within said body functioning to provide additional absorption or comfort.

18. The caregiver cover as recited in claim 13, further comprising:

a non-central fastener joined to a left or right side of said neck opening to vertically adjust said body to allow varied lengths of the caregiver cover.

19. The caregiver cover as recited in claim 17, further comprising: a middle panel sandwiched to said double layer, and included within said body functioning to provide additional absorption or comfort.

20. The caregiver cover as recited in claim 18, further comprising:

a burp cloth with a burp cloth fastener to fasten to said non-central fastener on said upper panel.

21. The caregiver cover as recited in claim 13, further comprising: a pocket on said body.

22. The caregiver cover as recited in claim 13, further comprising: a collar joined to said body.

23. The caregiver cover as recited in claim 13 wherein the releasable panel fasteners are selected from the group consisting of: hook and loop fasteners, snaps, buttons, cloth ties, magnets, and zippers.

24. The caregiver cover as recited in claim 15 further comprising a fastener joined to the lower edge of the lower panel which can be fastened to said central fastener to vertically adjust said body to allow varied lengths of the caregiver cover.

* * * * *